US008013794B2

(12) United States Patent
Sotoma et al.

(10) Patent No.: US 8,013,794 B2
(45) Date of Patent: Sep. 6, 2011

(54) SURFACE MOUNT ANTENNA AND ANTENNA MODULE

(75) Inventors: Naoki Sotoma, Tokyo (JP); Yasumasa Harihara, Tokyo (JP); Kenji Endo, Tokyo (JP); Takeshi Oohashi, Tokyo (JP)

(73) Assignee: TDK Corporation, Tokyo (JP)

( * ) Notice: Subject to any disclaimer, the term of this patent is extended or adjusted under 35 U.S.C. 154(b) by 387 days.

(21) Appl. No.: 12/318,415

(22) Filed: Dec. 29, 2008

(65) Prior Publication Data

US 2009/0179815 A1 Jul. 16, 2009

(30) Foreign Application Priority Data

Jan. 15, 2008 (JP) ..... 2008-005516

(51) Int. Cl.
*H01Q 1/38* (2006.01)

(52) U.S. Cl. ..... 343/700 MS

(58) Field of Classification Search ..... 343/700 MS, 343/702, 787, 833, 795, 810
See application file for complete search history.

(56) References Cited

U.S. PATENT DOCUMENTS

| | | | | |
|---|---|---|---|---|
| 6,803,881 | B2 * | 10/2004 | Ishihara et al. | 343/700 MS |
| 2002/0163470 | A1 | 11/2002 | Nagumo et al. | |
| 2009/0231201 | A1 * | 9/2009 | Annamaa et al. | 343/700 MS |

FOREIGN PATENT DOCUMENTS

| | | | |
|---|---|---|---|
| EP | 1 063 722 | A2 | 12/2000 |
| EP | 1 139 490 | A1 | 10/2001 |
| WO | WO 2007/094111 | A1 | 8/2007 |

OTHER PUBLICATIONS http://hyperphysics.phy-astr.gsu.edu/hbase/ tables/diel.html (listing of dielectric constants).* http://searchciomidmarket.techtarget.com/sDefinition/0,,sid183_gci546287,00.html, (definition of permittivity, dielectric).*

* cited by examiner

*Primary Examiner* — Huedung Mancuso
(74) *Attorney, Agent, or Firm* — Oliff & Berridge, PLC

(57) ABSTRACT

A surface mount antenna with small size and broadband is provided. The surface mount antenna includes: a substrate including a dielectric material or a magnetic material as a main material; a feed radiation conductor formed on the substrate, one end of the feed radiation conductor being a first feed end to be supplied with power, and the other end being a first open end; and a parasitic radiation conductor formed on the substrate at a distance from the feed radiation conductor, one end of the parasitic radiation conductor being a second feed end to be supplied with power from the feed radiation conductor through electromagnetic coupling, and the other end being a second open end. A region having a dielectric constant or a magnetic permeability lower than that of the main material of the substrate is provided between the feed radiation conductor and the parasitic radiation conductor.

10 Claims, 29 Drawing Sheets

SURFACE MOUNT ANTENNA AND ANTENNA MODULE

CROSS REFERENCE TO RELATED APPLICATIONS

The present invention contains subject matter related to Japanese Patent Application JP 2008-5516 filed in the Japanese Patent Office on Jan. 15, 2008, the entire contents of which being incorporated herein by reference.

BACKGROUND OF THE INVENTION

1. Field of the Invention

The present invention relates to a surface mount antenna and an antenna module used for a radio communication device such as mobile phone.

2. Background Art

As shown in FIG. 28, a surface mount antenna has been known in the past, the antenna being configured such that a feed radiation conductor 101 as a main radiation element (feed element), and a parasitic radiation conductor 102 as a parasitic element are adjacently disposed on a surface of a dielectric substrate 100 having a rectangular shape. The feed radiation conductor 101 has one end 101A being connected to a signal source 103 to supply power from a side of the one end 101A, and has the other end 101B formed to be an open end (signal radiation side). The parasitic radiation conductor 102 has one end 102A being short-circuited, and has the other end 102B formed to be an open end (signal radiation side). The feed radiation conductor 101 and the parasitic radiation conductor 102 have different resonance length from each other. For example, as shown in an equivalent circuit of FIG. 29, the feed radiation conductor 101 is formed to have a length of $\lambda_1/4$ (resonance frequency f1), and the parasitic radiation conductor 102 is formed to have a length of $\lambda_2/4$ (resonance frequency f2) shorter than the length of $\lambda_1/4$. In the surface mount antenna, power is supplied from the signal source 103 to the one end 101A of the feed radiation conductor 101, and power is supplied to the parasitic radiation conductor 102 via the feed radiation conductor 101 by electromagnetic coupling. In the surface mount antenna, the feed radiation conductor 101 and the parasitic radiation conductor 102 are double-resonated so as to secure a required frequency band.

Japanese Unexamined Patent Publication No. 2003-08326 discloses a surface mount antenna in a configuration where a feed radiation conductor and a parasitic radiation conductor are formed in a ring shape respectively in the same plane. Japanese Unexamined Patent Publication No. 2003-51705 discloses a surface mount antenna in a configuration where a feed radiation conductor and a parasitic radiation conductor are patterned such that respective open ends of the conductors are not adjacently disposed, but disposed away from each other.

SUMMARY OF THE INVENTION

FIG. 30 shows an example of a VSWR (Voltage Standing Wave Ratio) characteristic to frequency of a surface mount antenna having a configuration, for example, as shown in FIG. 28. To establish double resonance in the surface mount antenna, an interval between resonance frequency f1 of a feed element and resonance frequency f2 of a parasitic element needs to be increased, or a physical interval between both elements needs to be increased in order to decrease the amount of coupling between the feed element and the parasitic element. However, when the resonance frequency f1 of the feed element is excessively separated from the resonance frequency f2 of the parasitic element, a value of VSWR deteriorates in an intermediate frequency range between the resonance frequency f1 and the resonance frequency f2 as shown in FIG. 30, which makes it difficult to achieve broadband.

To achieve broadband, for example, as shown in FIG. 31, the resonance frequency f1 needs to be made close to the resonance frequency f2 within a range where double resonance is established. However, in a previous structure, when the resonance frequency f1 is made close to the resonance frequency f2 in order to achieve broadband, a physical interval between the feed element and the parasitic element has been necessary to be increased to decrease the amount of electromagnetic coupling between both the elements, leading to a difficulty of increased size of an antenna as a whole.

In the structure described in Japanese Unexamined Patent Publication No. 2003-08326, the radiation conductors configuring the feed element and parasitic element are formed into a ring shape respectively, which reduces the number of points at which a physical distance between the feed element and the parasitic element is decreased, therefore the resonance frequency f1 can be made close to the resonance frequency f2. However, the radiation conductors are formed into a ring shape respectively in the same plane, which prevents reduction in size of an antenna as a whole.

In the structure described in Japanese Unexamined Patent Publication No. 2003-51705, the open ends of the respective elements are disposed at positions away from each other to decrease the amount of electromagnetic coupling between the feed element and the parasitic element, therefore the radiation conductors are significantly different in electric length from each other, and the two resonance frequency f1 and f2 are considerably separated from each other, and consequently the structure is not suitable to meet the issue that the two resonance frequencies f1 and f2 are made close to each other to achieve broadband as shown in FIG. 31. Moreover, when an antenna is reduced in size, if a dielectric having a high dielectric constant is selected as a substrate, length of an open end needs to be increased. Furthermore, since formation positions of open ends of the radiation conductors are different from each other, when each radiation conductor is mounted on a circuit board, the radiation conductor is hardly mounted in an optimum direction in which each radiation conductor has a good radiation characteristic. That is, when one radiation conductor is mounted while being optimized in a direction in which a good radiation characteristic is obtained, the other radiation conductor deteriorates in radiation characteristic.

In view of forgoing, it is desirable to provide a surface mount antenna and an antenna module, in which both of small size and broadband can be achieved.

A surface mount antenna according to an embodiment of the invention includes a substrate including a dielectric material or a magnetic material as a main material; a feed radiation conductor formed on a surface of the substrate, one end of the feed radiation conductor being formed as a first feed end to be supplied with power, and the other end thereof being formed as a first open end; and a parasitic radiation conductor formed on the surface of the substrate at a distance from the feed radiation conductor, one end of the parasitic radiation conductor being formed as a second feed end to be supplied with power from the feed radiation conductor through an action of electromagnetic coupling, and the other end thereof being formed as a second open end; wherein a region having a dielectric constant lower than that of the main material of the substrate or having a magnetic permeability lower than that of the main material of the substrate is provided between the feed radiation conductor and the parasitic radiation conductor.

An antenna module according to an embodiment of the invention is configured by mounting the surface mount antenna according to an embodiment of the invention on a circuit board.

In the surface mount antenna or the antenna module according to an embodiment of the invention, the region having a lower dielectric constant than a dielectric constant of the substrate (or the region having a lower magnetic permeability than a magnetic permeability of the substrate) is provided between the feed radiation conductor and the parasitic radiation conductor, so that the amount of electromagnetic coupling between the radiation conductors can be decreased. The amount of electromagnetic coupling between the radiation conductors is decreased, thereby resonance frequencies of the radiation conductors can be made close to each other within a range where double resonance may be established, so that broadband can be achieved. In the past, a physical distance between the radiation conductors has been necessary to be increased in order to decrease the amount of electromagnetic coupling, and therefore small size has been hardly achieved. However, in an embodiment of the invention, the region having a low dielectric constant (or the region having a low magnetic permeability) is provided, thereby a small broadband antenna using double resonance can be achieved without increasing the physical distance.

In the surface mount antenna according to an embodiment of the invention, the region having a low dielectric constant (or the region having a low magnetic permeability) can be achieved by forming one or more grooves on the substrate in at least a part of a region between the feed radiation conductor and the parasitic radiation conductor. Inside spaces of the grooves function as the region having a low dielectric constant or a low magnetic permeability.

In this case, the grooves are formed as an air layer, so that the grooves are reduced in dielectric constant (or magnetic permeability) compared with the substrate.

In the surface mount antenna according to an embodiment of the invention, the substrate may have a rectangular solid shape with a first surface, a second surface perpendicular to the first surface and a third surface opposed to the first surface, and the feed radiation conductor and the parasitic radiation conductor may be formed in parallel with each other to extend around the substrate along the first, the second and the third surfaces.

In the surface mount antenna according to an embodiment of the invention, the first feed end of the feed radiation conductor and the second feed end of the parasitic radiation conductor may be located on the first surface of the substrate. A width, at least at the first feed end, of the feed radiation conductor on the first surface may be larger than a width of the feed radiation conductor on the other surfaces, and a width, at least at the second feed end, of the parasitic radiation conductor on the first surface may be larger than a width of the parasitic radiation conductor on the other surfaces.

In the case of such a configuration, a conductor at a feed side, through which much current flows, is formed larger in width, so that a resistance value is decreased in such a portion, leading to ease in current flow. This improves radiation efficiency.

Furthermore, in this case, the first open end of the feed radiation conductor and the second open end of the parasitic radiation conductor may be located on the third surface of the substrate. In addition, grooves may be formed on at least the first surface and the third surface of the substrate in a region between the feed radiation conductor and the parasitic radiation conductor, and a groove formed in the third surface may be larger than that formed in the first surface.

In a case of such a configuration, conductor width at a feed side is made larger, thereby even if the amount of electromagnetic coupling increases at the feed side, the amount of electromagnetic coupling can be decreased at the open end side by the groove formed in the third surface.

Alternatively, in the surface mount antenna according to an embodiment of the invention, the first open end of the feed radiation conductor and the second open end of the parasitic radiation conductor may be located on the third surface of the substrate. A width, at least at the first open end, of the feed radiation conductor on the third surface may be larger than a width of the feed radiation conductor on the other surfaces, and a width, at least at the second open end, of the parasitic radiation conductor on the third surface may be larger than a width of the parasitic radiation conductor on the other surfaces.

In the case of such a configuration, width of a conductor at an open end side is formed larger, so that resonance frequency can be reduced, leading to ease in size reduction.

Furthermore, in this case, the first feed end of the feed radiation conductor and the second feed end of the parasitic radiation conductor may be located on the first surface of the substrate. In addition, grooves may be formed on at least the first surface and the third surface of the substrate in a region between the feed radiation conductor and the parasitic radiation conductor, and a groove formed in the first surface may be larger than that formed in the third surface.

In a case of such a configuration, conductor width at an open end side is made larger, thereby even if the amount of electromagnetic coupling increases at the open end side, the amount of electromagnetic coupling can be decreased at the feed side by the groove formed in the first surface.

In the surface mount antenna according to an embodiment of the invention, a conductor portion in a neighborhood of the first open end in the feed radiation conductor and a conductor portion in a neighborhood of the second open end in the parasitic radiation conductor may be configured to extend onto different surfaces which are perpendicular to the first to third surfaces.

In this case, since each conductor is configured to extend onto different surfaces, conductor length is increased, and thereby resonance frequency can be reduced, leading to ease in size reduction.

The surface mount antenna according to an embodiment of the invention further includes a circuit element for adjusting a frequency characteristic. The circuit element may be connected, via a capacitor, to the first open end of the feed radiation conductor, or to the second open end of the parasitic radiation conductor, or to both of them.

In this case, for example, an inductance element or a capacitance element is provided as the circuit element for adjusting a frequency characteristic via capacitance, which enables adjustment of the amount of electromagnetic coupling occurring via a ground electrode on the circuit board. Thus, an interval and central frequency of double resonance may be adjusted. Therefore, even if frequency is shifted due to other components disposed near an antenna, the frequency can be readjusted to a desired frequency, consequently various devices may be managed by a single antenna, the devices being disposed near the antenna, and having different components. Moreover, a frequency characteristic is adjusted at a circuit element side, thereby an antenna can be formed into an approximately symmetric configuration, leading to reduction in dependence on a feed direction.

In the antenna module according to an embodiment of the invention, the surface mount antenna is preferably mounted such that the first open end of the feed radiation conductor and the second open end of the parasitic radiation conductor is situated to point inward on the circuit board.

Thus, radiation efficiency is improved compared with a case where the antenna is mounted such that the open end is situated at an outer side on the circuit board.

According to the surface mount antenna or the antenna module of an embodiment of the invention, a region having a lower dielectric constant than a dielectric constant of a substrate (or a region having a lower magnetic permeability than a magnetic permeability of the substrate) is provided between a feed radiation conductor and a parasitic radiation conductor. Therefore, the amount of electromagnetic coupling between the radiation conductors can be decreased without increasing a physical distance between the radiation conductors. In addition, resonance frequencies of the radiation conductors can be made close to each other, so that broadband can be achieved without increasing a physical distance between the radiation conductors. Thus, both of small size and broadband can be achieved.

Other and further objects, features and advantages of the invention will appear more fully from the following description.

BRIEF DESCRIPTION OF THE DRAWINGS

FIGS. 1A and 1B show a configuration example of an antenna module according to a first embodiment of the invention, wherein FIG. 1A shows a perspective view seen from a radiation side, and FIG. 1B shows a side view seen from the radiation side;

FIGS. 2A and 2B show a configuration example of the antenna module according to the first embodiment of the invention, wherein FIG. 2A shows a perspective view seen from a feed side, and FIG. 2B shows a side view seen from the feed side;

FIGS. 6A and 6B show explanatory views of a mounting position of a surface mount antenna according to the first embodiment of the invention with respect to a circuit board, wherein FIG. 6A shows an example of a preferable mounting position, and FIG. 6B shows an example of an unfavorable mounting position;

FIGS. 7A and 7B show a configuration example of an antenna module according to a second embodiment of the invention, wherein FIG. 7A shows a perspective view seen from a radiation side, and FIG. 7B shows a side view seen from the radiation side;

FIGS. 8A and 8B show a configuration example of the antenna module according to the second embodiment of the invention, wherein FIG. 8A shows a perspective view seen from a feed side, and FIG. 8B shows a side view seen from the feed side;

FIGS. 10A and 10B show a configuration example of an antenna module according to a third embodiment of the invention, wherein FIG. 10A shows a perspective view seen from a radiation side, and FIG. 10B shows a side view seen from the radiation side;

FIGS. 11A and 11B show a configuration example of the antenna module according to the third embodiment of the invention, wherein FIG. 11A shows a perspective view seen from a feed side, and FIG. 11B shows a side view seen from the feed side;

FIGS. 13A and 13B show a configuration example of an antenna module according to a fourth embodiment of the invention, wherein FIG. 13A shows a perspective view seen from a radiation side, and FIG. 13B shows a side view seen from the radiation side;

FIGS. 14A and 14B show a configuration example of the antenna module according to the fourth embodiment of the invention, wherein FIG. 14A shows a perspective view seen from a feed side, and FIG. 14B shows a side view seen from the feed side;

FIGS. 16A and 16B show a configuration example of an antenna module according to a fifth embodiment of the invention, wherein FIG. 16A shows a perspective view seen from a radiation side, and FIG. 16B shows a side view seen from the radiation side;

FIGS. 17A and 17B show a configuration example of the antenna module according to the fifth embodiment of the invention, wherein FIG. 17A shows a perspective view seen from a feed side, and FIG. 17B shows a side view seen from the feed side;

FIGS. 21A and 21B show a configuration example of an antenna module according to a seventh embodiment of the invention, wherein FIG. 21A shows a perspective view seen from a radiation side, and FIG. 21B shows a side view seen from the radiation side;

FIGS. 22A and 22B show a configuration example of the antenna module according to the seventh embodiment of the invention, wherein FIG. 22A shows a perspective view seen from a feed side, and FIG. 22B shows a side view seen from the feed side;

FIGS. 24A and 24B show a configuration example of an antenna module according to a eighth embodiment of the invention, wherein FIG. 24A shows a perspective view seen from a radiation side, and FIG. 24B shows a side view seen from the radiation side;

FIGS. 25A and 25B show a configuration example of the antenna module according to the eighth embodiment of the invention, wherein FIG. 25A shows a perspective view seen from a feed side, and FIG. 25B shows a side view seen from the feed side;

DETAILED DESCRIPTION OF THE PREFERRED EMBODIMENTS

Hereinafter, embodiments of the invention will be described in detail with reference to drawings.

First Embodiment

Figure 1A:
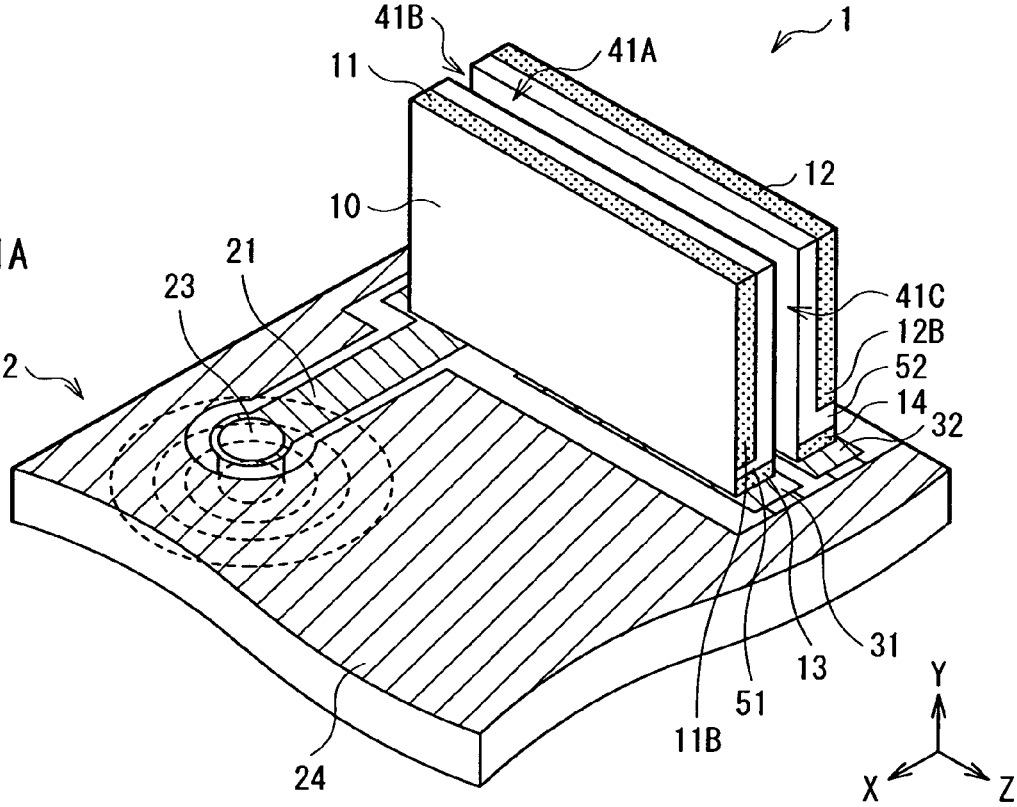
Figure 1B:
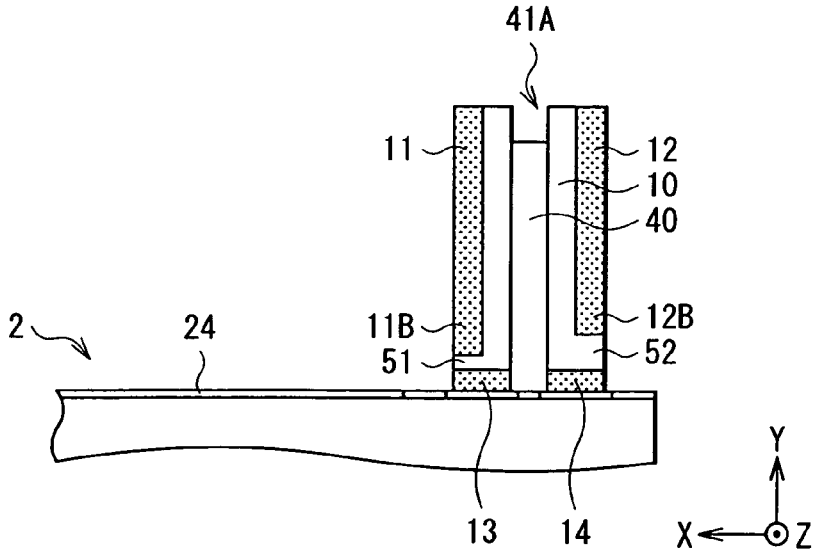
Figure 2A:
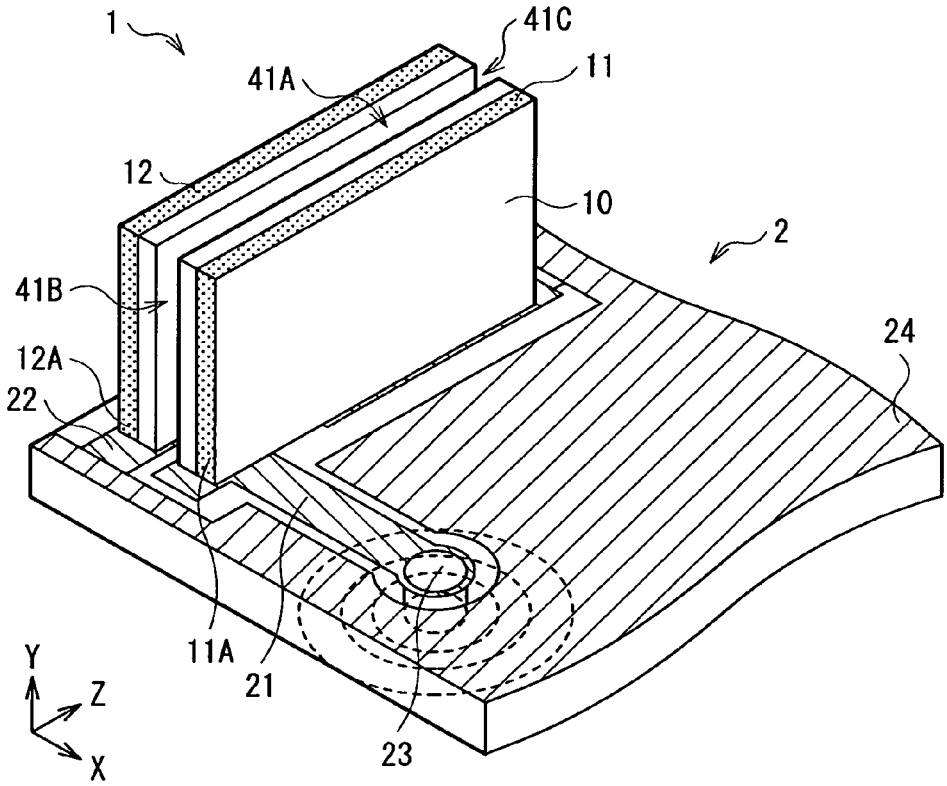
Figure 2B:
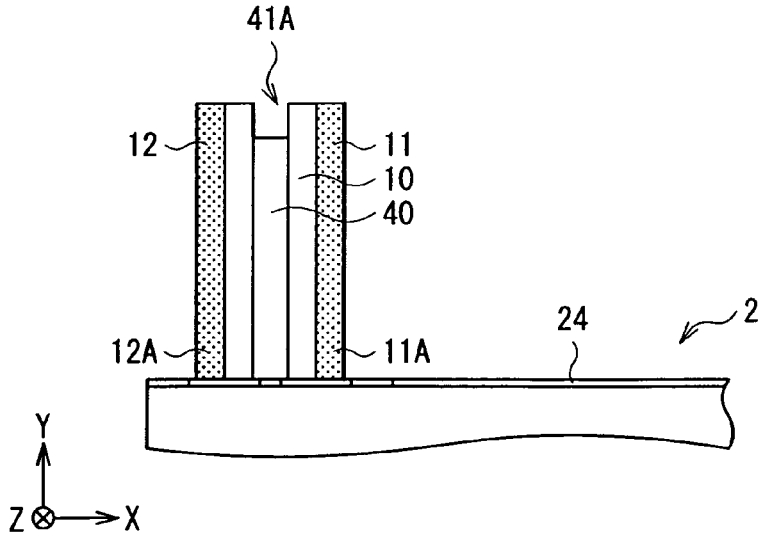
Figure 3:
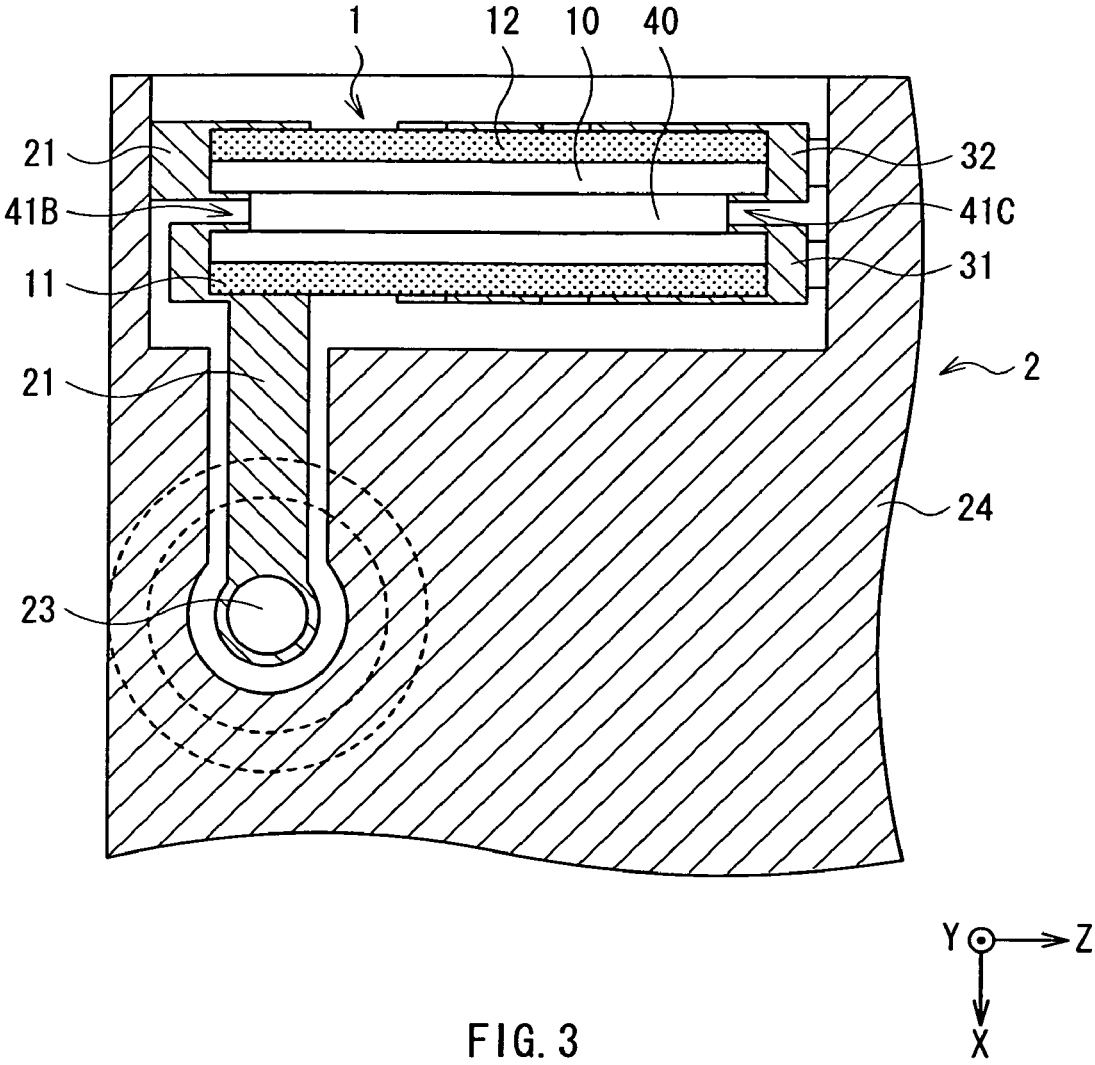
FIG. 3 shows a top view showing a configuration example of the antenna module according to the first embodiment of the invention.
Figure 4:
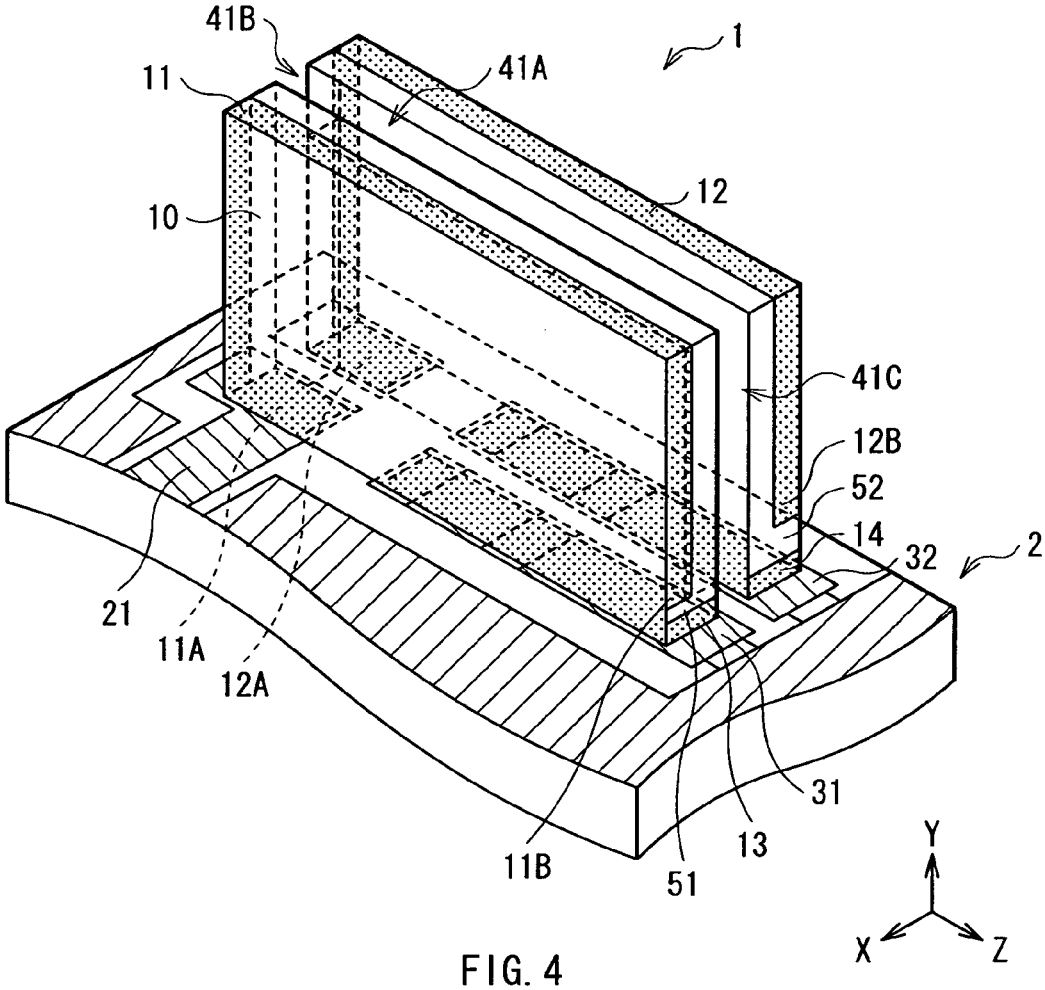
FIG. 4 shows a see-through perspective view seen from the radiation side, showing a configuration example of the antenna module according to the first embodiment of the invention.
Figure 5:
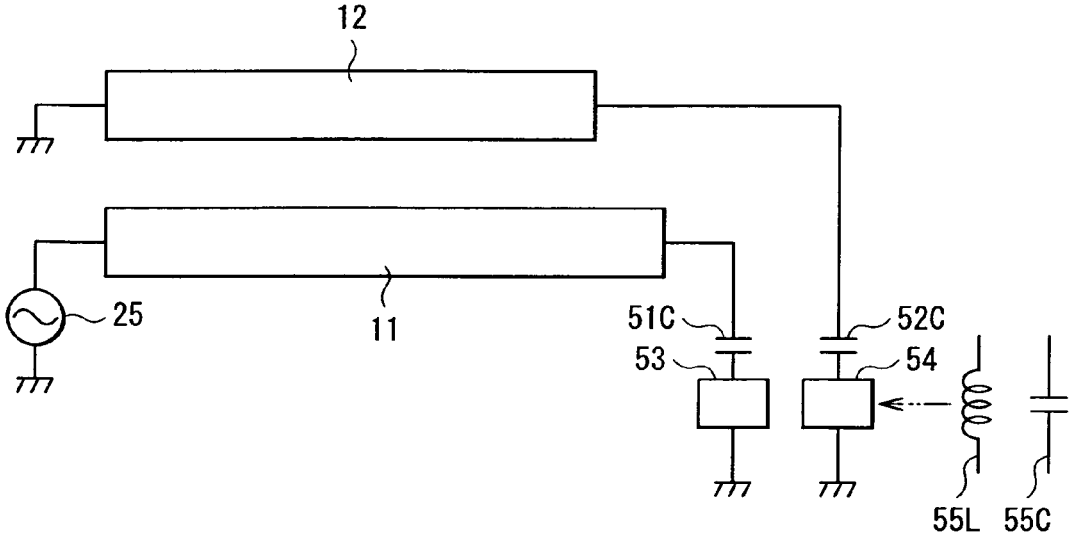
FIG. 5 shows an equivalent circuit diagram of the antenna module according to the first embodiment of the invention.

FIGS. 1A and 1B show a configuration example of an antenna module mounted with a surface mount antenna 1 according to the embodiment. In particular, FIG. 1A shows the antenna module in a manner of being obliquely seen from a radiation side (open end side) of the surface mount antenna 1, and FIG. 1B shows a side face of the module at the radiation side. FIG. 2A shows the antenna module in a manner of being obliquely seen from a feed side of the surface mount antenna 1, and FIG. 2B shows a side face of the module at the feed side. FIG. 3 shows a configuration of the antenna module seen from a top. FIG. 4 shows the configuration shown in FIG. 1A in a see-through manner. FIG. 5 shows an equivalent circuit of the antenna module.

The antenna module has a plate-like circuit board 2, and the surface mount antenna 1 mounted on a top of the circuit board 2. On the top of the circuit board 2, a ground electrode layer 24 is formed in regions other than a region where the surface mount antenna 1 is mounted. Moreover, on the top of the circuit board 2, a feed section 23 to be connected to an external signal source 25 (FIG. 5), a source connection electrode 21 for connecting the feed section 23 to a feed element of the surface mount antenna 1, and a ground connection terminal electrode 22 for connecting a parasitic element of the surface mount antenna 1 to the ground electrode layer 24 are provided near the region where the surface mount antenna 1 is mounted. In addition, on the top of the circuit board 2, circuit connection electrodes 31 and 32 are provided near the region where the surface mount antenna 1 is mounted.

The surface mount antenna 1 has a dielectric substrate 10 configured of a dielectric block having an approximately rectangular shape including a dielectric material as a main material. On a surface of the dielectric substrate 10, a feed radiation conductor 11 as a main radiation element (feed element), and a parasitic radiation conductor 12 as a parasitic element are formed by a line pattern of a conductor (strip line).

The feed radiation conductor 11 has one end 11A as a first feed end being connected to the signal source 25 via the source connection electrode 21 and the feed section 23 formed on the circuit board 2 so that power is supplied from a side of the one end 11A, and has the other end 11B formed to be a first open end (signal radiation side). The one end 11A of the feed radiation conductor 11 is formed such that it slightly comes into a bottom of the dielectric substrate 10 as shown in FIG. 4 so as to be connected to the source connection electrode 21 on the bottom.

The parasitic radiation conductor 12 has one end 12A as a second feed end being connected to the ground electrode layer 24 via the ground connection terminal electrode 22 formed on the circuit board 2 and thus shorted. The parasitic radiation conductor 12 is supplied with power on a side of the one end 12A via the feed radiation conductor 11 by electromagnetic coupling. The one end 12A of the parasitic radiation conductor 12 is formed such that it slightly comes into a bottom of the dielectric substrate 10 as shown in FIG. 4 so as to be connected to the ground connection terminal electrode 22 on the bottom. The other end 12B of the parasitic radiation conductor 12 is formed to be a second open end (signal radiation side). The feed radiation conductor 11 and the parasitic radiation conductor 12 are formed to be different in conductor length to establish double resonance.

The feed radiation conductor 11 and the parasitic radiation conductor 12 are formed in a parallel manner with a certain interval such that each conductor goes around a first surface of the dielectric substrate 10 (one side face shown in FIG. 2B), a second surface thereof (top shown in FIG. 3) perpendicular to the first surface, and a third surface thereof (the other side face shown in FIG. 1B) opposed to the first surface. Thus, the feed radiation conductor 11 and the parasitic radiation conductor 12 are configured such that one ends 11A and 12A at a feed side are formed in a parallel manner to the first surface (one side face) of the dielectric substrate 10, and the other ends 11B and 12B at an open end side are formed in a parallel manner to the third surface (the other side face opposed to one side face) of the dielectric substrate 10 respectively. Conductor width of the feed radiation conductor 11 is formed to be approximately the same as that of the parasitic radiation conductor 12 on each of the first to third surfaces.

The surface mount antenna 1 has a region having a lower dielectric constant than that of the dielectric substrate 10 between the feed radiation conductor 11 and the parasitic radiation conductor 12. More specifically, portions (a substrate top portion 41A and substrate side portions 41B and 41C) corresponding to a region of the dielectric substrate 10 between the feed radiation conductor 11 and the parasitic radiation conductor 12 are formed into a groove shape, and each portion formed into the groove shape is formed as an air layer, thereby the periphery of a substrate center portion 40 is made as a region having a low dielectric constant except a bottom of the portion 40. The substrate top portion 41A and the substrate side portions 41B and 41C are made to be approximately the same in groove width and in groove depth.

In the surface mount antenna 1, as shown in FIGS. 1A and 1B, a characteristic adjustment terminal electrode 13 is formed on an open end side (side of the other end 11B) of the feed radiation conductor 11 via a gap portion 51 corresponding to capacitance 51C (FIG. 5). Similarly, a characteristic adjustment terminal electrode 14 is formed on an open end side (side of the other end 12B) of the parasitic radiation conductor 12 via a gap portion 52 corresponding to capacitance 52C (FIG. 5). The characteristic adjustment terminal electrodes 13 and 14 are formed such that they come into the bottom of the dielectric substrate 10 as shown in FIG. 4, and connected on the bottom to the circuit connection electrodes 31 and 32 on the circuit board 2 respectively.

The circuit connection electrodes 31 and 32 are connected with adjustment circuit elements 53 and 54 for adjusting a frequency characteristic as shown in the equivalent circuit of FIG. 5 respectively. Thus, the feed radiation conductor 11 is connected with the adjustment circuit element 53 at the open end side thereof via the characteristic adjustment terminal electrode 13 and the circuit connection electrode 31. Similarly, the parasitic radiation conductor 12 is connected with the adjustment circuit element 54 at the open end side thereof via the characteristic adjustment terminal electrode 14 and the circuit connection electrode 32. For the adjustment circuit elements 53 and 54, an adjustment capacitance element 55C or an adjustment inductance element 55L may be used.

The adjustment circuit elements 53 and 54 may be provided at the open end of only one of the feed radiation conductor 11 and the parasitic radiation conductor 12.

The surface mount antenna 1 of the embodiment can be manufactured, for example, according to the following process.

(1) First, dielectric granules are molded into a block body having a rectangular shape by die molding, and then the block body is baked and thus a dielectric sintered body is obtained. In such molding, when a die is used, the die being beforehand shaped to have a configuration corresponding to the groove of the dielectric substrate 10, grooving is not necessary after baking. When the groove configuration is not formed by die molding, the block body having the rectangular shape is subjected to grooving by using a processing machine such as an outer slicer.

(2) The sintered body is used as the dielectric substrate 10, and silver paste (Au, Cu or Al paste may be used instead) to be a radiation conductor and the like is printed thereon, and then baked in air atmosphere by a tunnel baking furnace or the like. The conductor is printed after forming the groove, thereby waste of silver paste can be prevented.

Next, operation of the antenna module according to the embodiment is described together with an advantage.

In the antenna module, power is supplied from the external signal source 25 to the one end 11A of the feed radiation conductor 11 via the feed connection electrode 21 and the feed section 23 formed on the circuit board 2, and power is supplied to the parasitic radiation conductor 12 via the feed radiation conductor 11 by electromagnetic coupling. This induces double resonance of the feed radiation conductor 11 and the parasitic radiation conductor 12, consequently antenna operation is performed at a desired frequency band.

In the antenna module, the region having a lower dielectric constant than that of the dielectric substrate 10 is provided between the feed radiation conductor 11 and the parasitic radiation conductor 12 of the surface mount antenna 1, thereby the amount of electromagnetic coupling between the radiation conductors can be decreased. The amount of electromagnetic coupling between the radiation conductors is decreased, thereby resonance frequencies of the radiation conductors can be made close to each other within a range where double resonance is established, leading to achievement of broadband. In the past, a physical distance between the radiation conductors has been necessary to be increased to decrease the amount of electromagnetic coupling, and therefore size reduction has been difficult. However, in the surface mount antenna 1, since the region having a low dielectric constant is provided, a small broadband antenna using double resonance can be achieved without increasing a physical distance.

In the antenna module, the adjustment circuit elements 53 and 54 for adjusting a frequency characteristic are connected to the open ends of the feed radiation conductor 11 and the parasitic radiation conductor 12 of the surface mount antenna 1 via capacitance 51C and 52C (gap portions 51 and 52) respectively, therefore the amount of electromagnetic coupling occurring via the ground electrode layer 24 on the circuit board 2 can be adjusted. Thus, an interval and central frequency of double resonance can be adjusted. Therefore, even if frequency is shifted due to other components disposed near the surface mount antenna 1, frequency can be readjusted to a desired frequency, consequently various devices may be managed by a single antenna, the devices being disposed near the antenna, and having different components. Moreover, since a frequency characteristic is adjusted at a circuit element side, an antenna can be formed into an approximately symmetric configuration, leading to reduction in dependence on a feed direction.

Figure 6A:
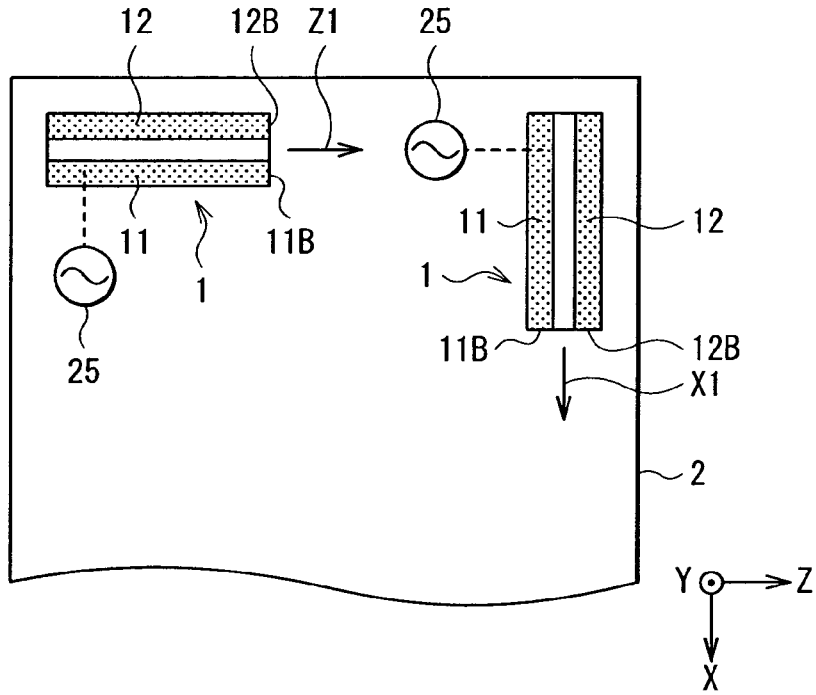
Figure 6B:
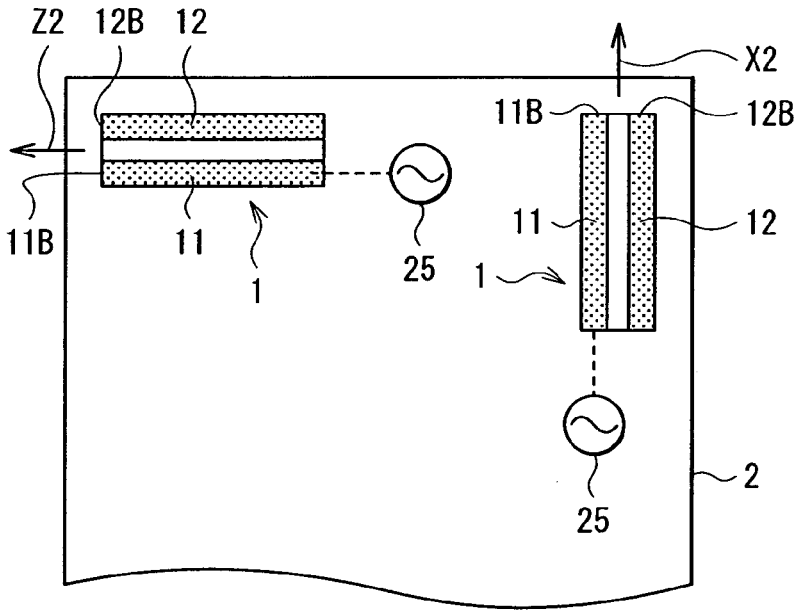

Here, a preferable mounting position of the surface mount antenna 1 with respect to the circuit board 2 is described with reference to FIGS. 6A and 6B. In the antenna module, the surface mount antenna 1 is preferably mounted such that each of the open ends (the other ends 11B and 12B) of the feed radiation conductor 11 and the parasitic radiation conductor 12 is situated at an inner side on the circuit board 2 (for example, a Z1 direction or an X1 direction in FIG. 6A) as shown in FIG. 6A. Thus, radiation efficiency is improved compared with a case where the antenna 1 is mounted such that the open end is situated at an outer side (for example, a Z2 direction or an X2 direction in FIG. 6B) on the circuit board 2 (FIG. 6B). In the antenna module, since the surface mount antenna 1 is configured such that the respective open ends of the feed radiation conductor 11 and the parasitic radiation conductor 12 are situated in the same direction, both the open ends of the feed radiation conductor 11 and the parasitic radiation conductor 12 can be directed to an inner side on the circuit board 2, and consequently radiation efficiency can be easily improved.

As described hereinbefore, according to an embodiment of the invention, since the region having a lower dielectric constant than that of the dielectric substrate 10 is provided between the feed radiation conductor 11 and the parasitic radiation conductor 12, the amount of electromagnetic coupling between the radiation conductors can be decreased without increasing a physical distance between the radiation conductors, and consequently resonance frequencies of the respective radiation conductors can be made close to each other, leading to achievement of broadband. Thus, both small size and broadband can be achieved.

Second Embodiment

Next, a second embodiment of the invention is described. Substantially the same components as in the antenna module according to the first embodiment are marked with the same symbols, and description of them is appropriately omitted.

Figure 7A:
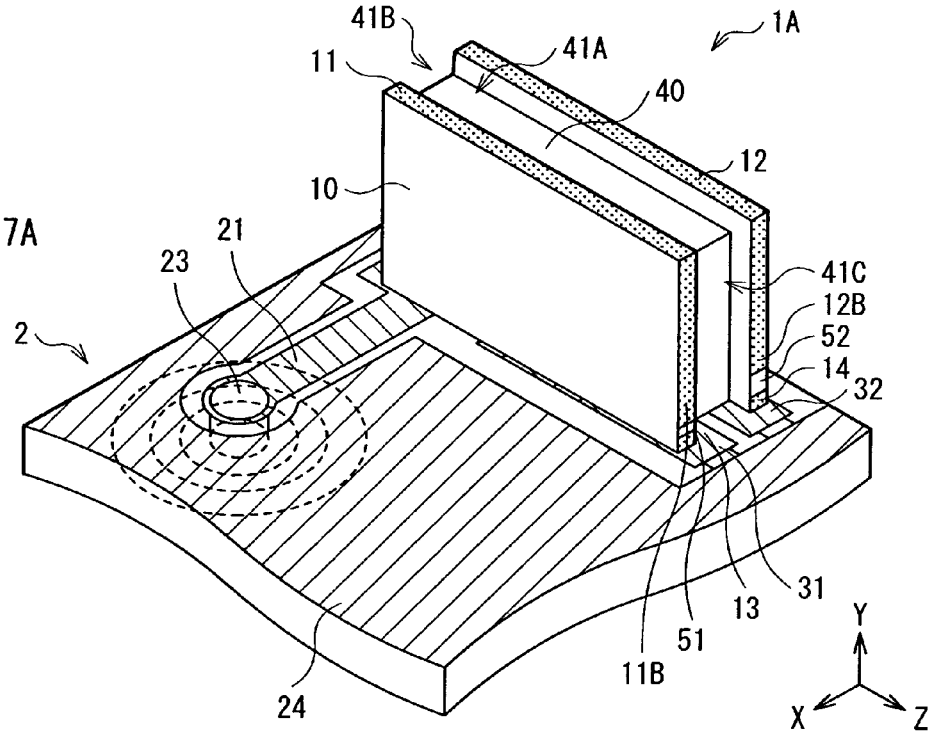
Figure 7B:
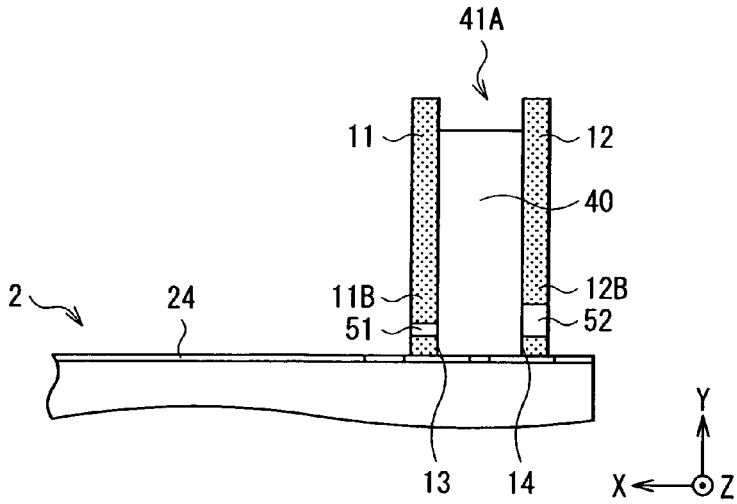
Figure 8A:
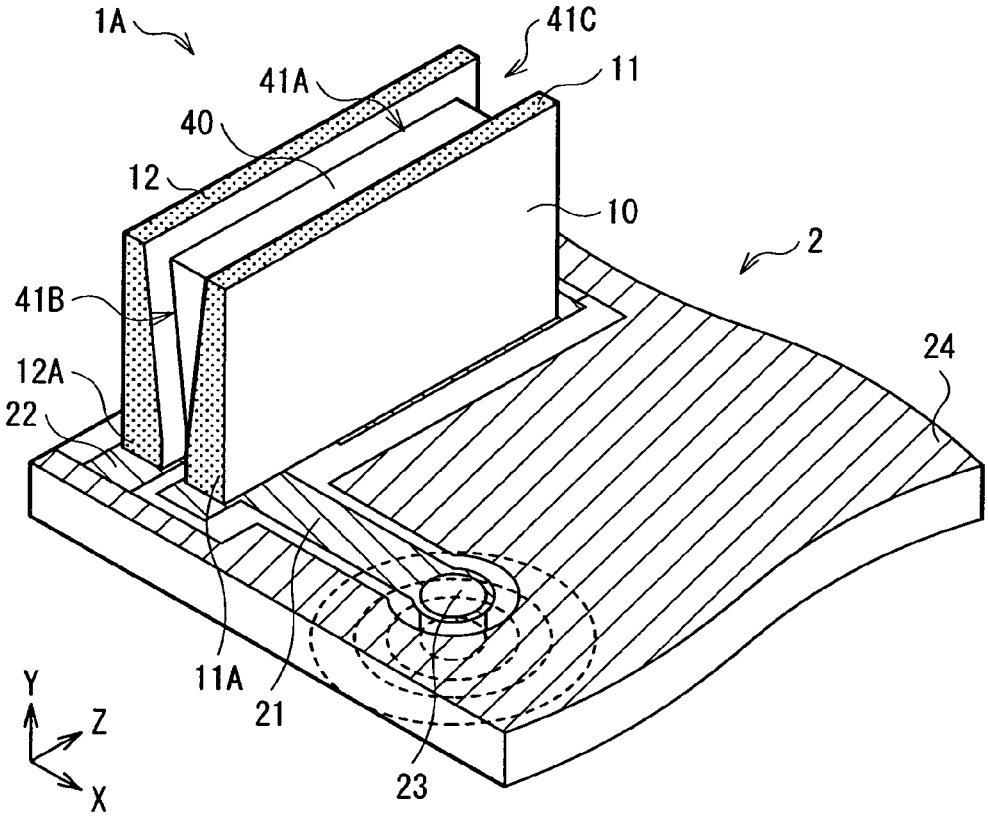
Figure 8B:
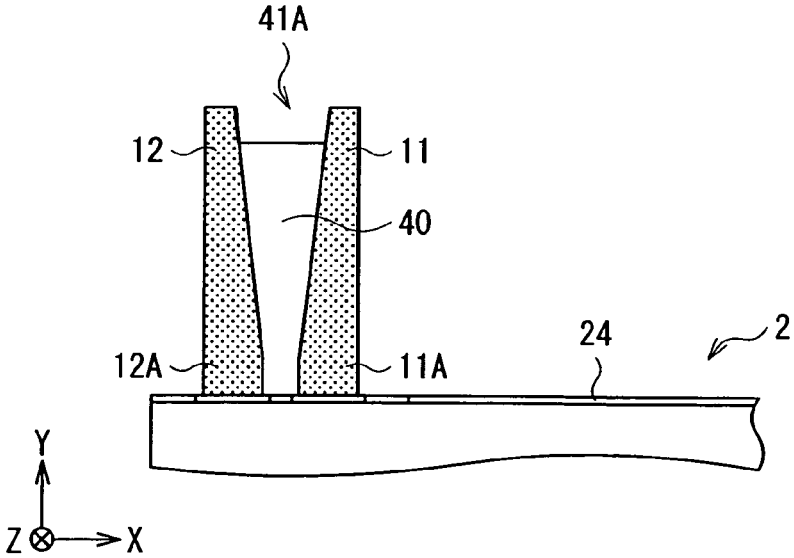
Figure 9:
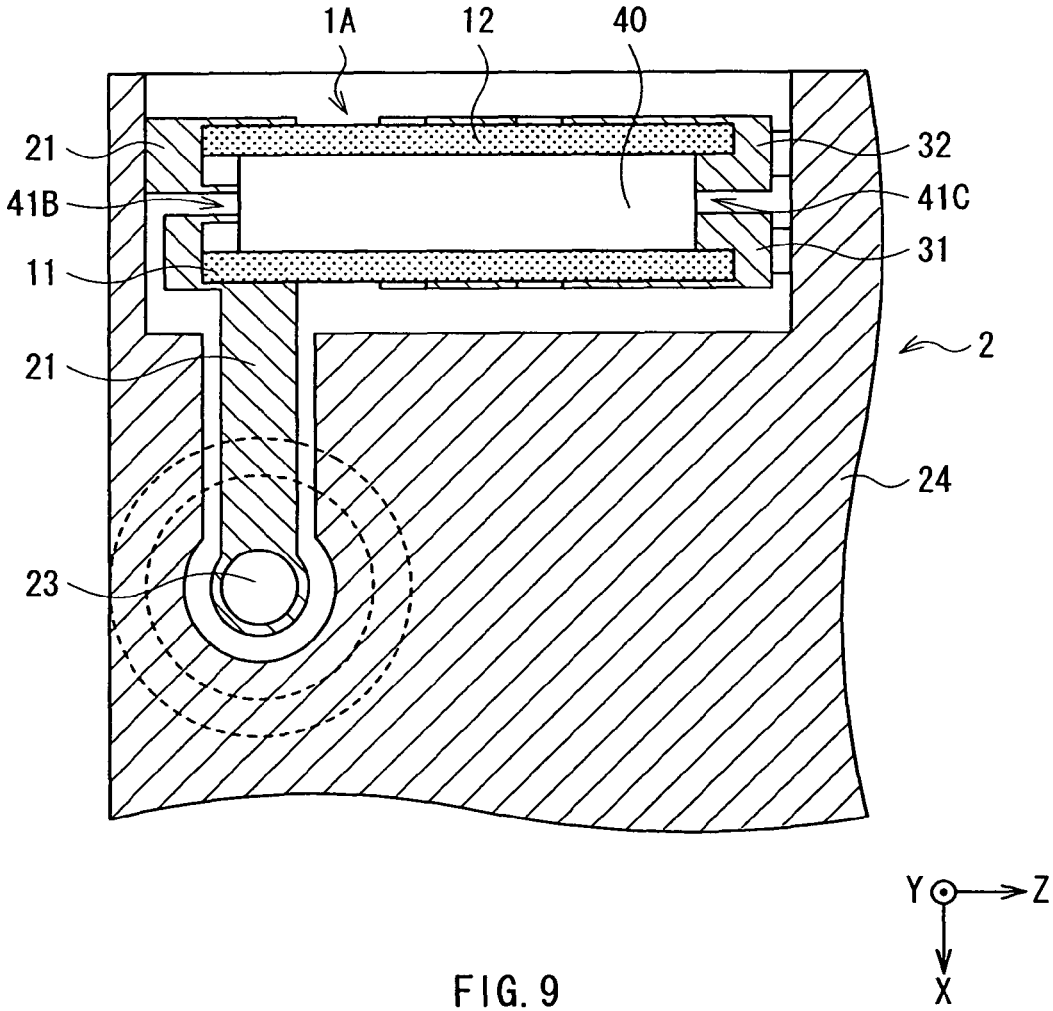
FIG. 9 shows a top view showing a configuration example of the antenna module according to the second embodiment of the invention.

FIGS. 7A and 7B show a configuration example of an antenna module mounted with a surface mount antenna 1A according to the embodiment. In particular, FIG. 7A shows the antenna module in a manner of being obliquely seen from a radiation side (open end side) of the surface mount antenna 1A, and FIG. 7B shows a side face of the module at the radiation side. FIG. 8A shows the antenna module in a manner of being obliquely seen from a feed side of the surface mount antenna 1A, and FIG. 8B shows a side face of the module at the feed side. FIG. 9 shows a configuration of the antenna module seen from a top.

The surface mount antenna 1 according to the first embodiment is configured such that each of the feed radiation conductor 11 and the parasitic radiation conductor 12 has approximately the same conductor width on the first to third surfaces respectively. However, the embodiment is configured such that each conductor is partially varied in configuration and size. In addition, the surface mount antenna 1 according to the first embodiment is configured such that the groove is approximately the same in width and depth in the substrate top portion 41A and the substrate side portions 41B and 41C respectively. However, the embodiment is configured such that a groove is partially varied in configuration and size.

Specifically, each of the feed radiation conductor 11 and the parasitic radiation conductor 12 at the feed side formed on the first surface (one side face) is configured such that its conductor width is large compared with conductor portions formed on other surfaces. More specifically, each of conductors 11 and 12 is configured to have such a tapered shape that the conductor becomes wider with approaching an end at a feed side (one end 11A or 12A) (refer to FIGS. 8A and 8B). Thus, since the conductor at the feed side, through which much current flows, is formed larger in width, a resistance value of such a conductor portion is decreased, leading to easy flow of current. This improves radiation efficiency.

Moreover, each of grooves formed in the second surface (substrate top portion 41A) and the third surface (substrate side portion 41C) of the dielectric substrate 10 is configured to be larger than a groove formed in the first surface (substrate side portion 41B) thereof. Thus, even if the amount of electromagnetic coupling increases at the feed side due to the increased conductor width at the feed side, since grooves are formed larger in other surfaces, the amount of electromagnetic coupling can be decreased particularly at an open end side.

Third Embodiment

Next, a third embodiment of the invention is described. Substantially the same components as in the antenna module according to each of the above embodiments are marked with the same symbols, and description of them is appropriately omitted.

Figure 10A:
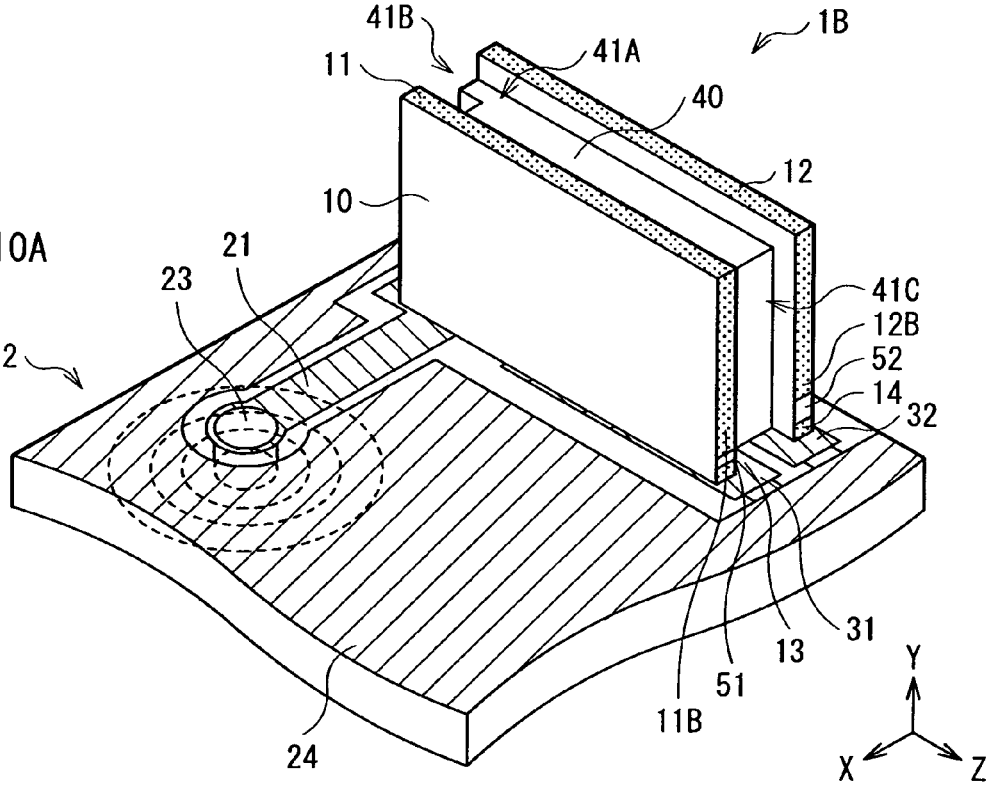
Figure 10B:
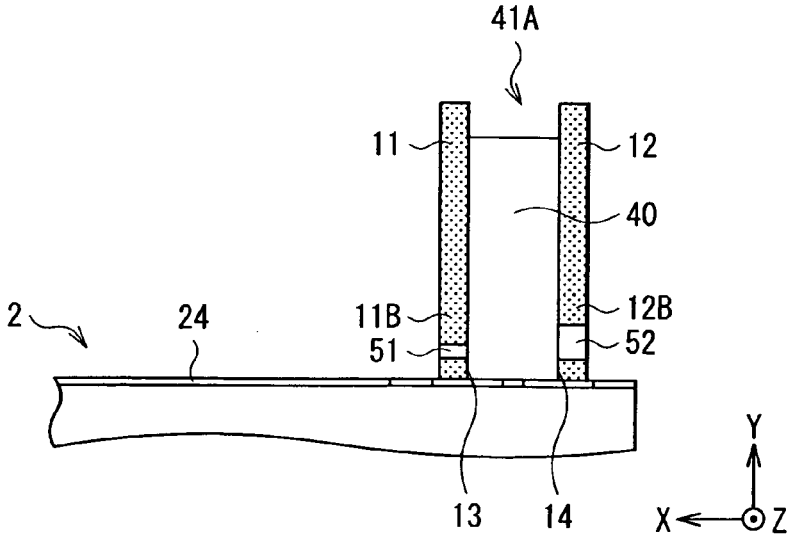
Figure 11A:
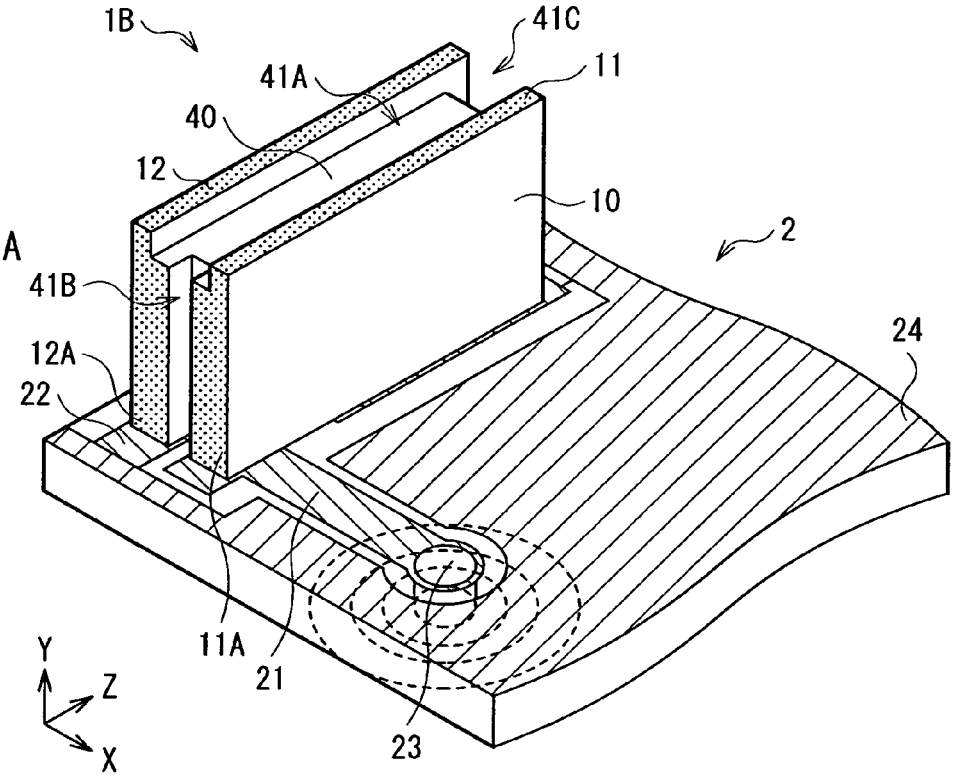
Figure 11B:
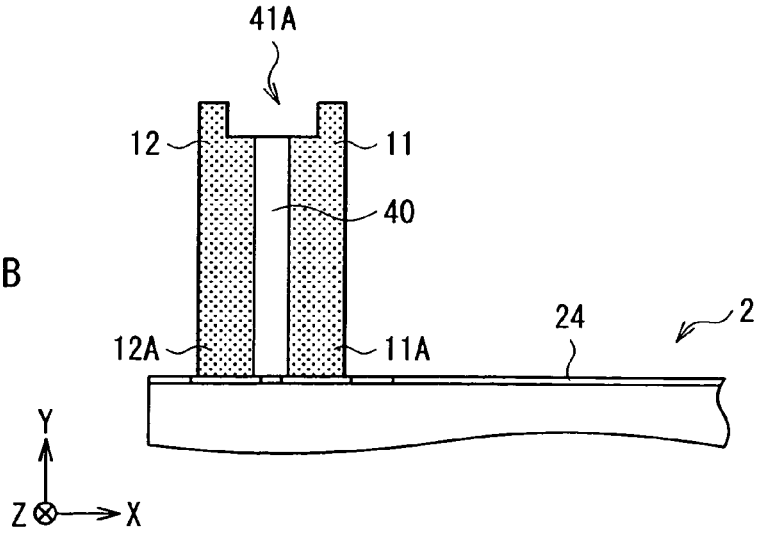
Figure 12:
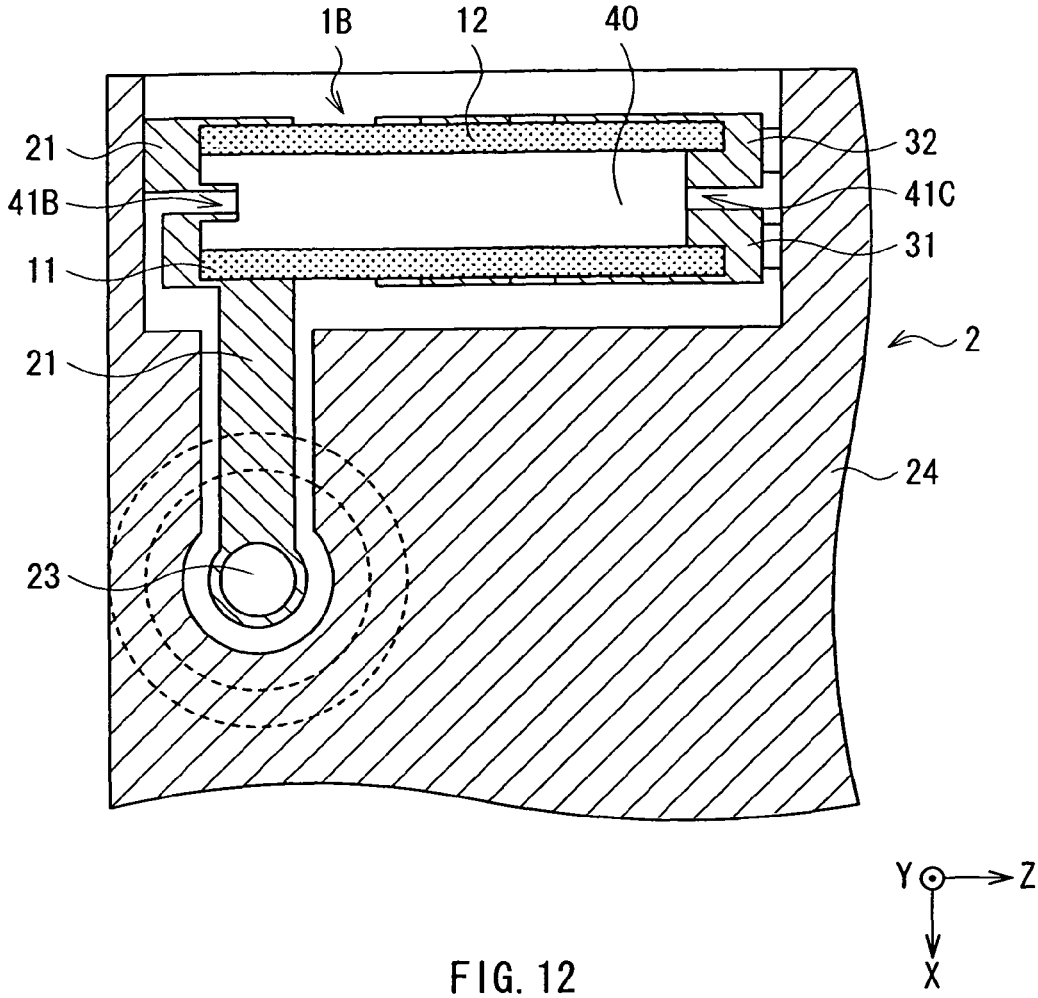
FIG. 12 shows a top view showing a configuration example of the antenna module according to the third embodiment of the invention.

FIGS. 10A and 10B show a configuration example of an antenna module mounted with a surface mount antenna 1B according to the embodiment. In particular, FIG. 10A shows the antenna module in a manner of being obliquely seen from a radiation side (open end side) of the surface mount antenna 1B, and FIG. 10B shows a side face of the module at the radiation side. FIG. 11A shows the antenna module in a manner of being obliquely seen from a feed side of the surface mount antenna 1B, and FIG. 11B shows a side face of the module at the feed side. FIG. 12 shows a configuration of the antenna module seen from a top.

As in the surface mount antenna 1A according to the second embodiment, the surface mount antenna 1B according to the embodiment is configured such that each of the feed radiation conductor 11 and the parasitic radiation conductor 12 is partially varied in conductor configuration and size. In addition, the embodiment is configured such that grooves of the dielectric substrate 10 are partially different in configuration and size from one another.

Specifically, each of the feed radiation conductor 11 and the parasitic radiation conductor 12 at the feed side formed on the first surface (one side face) is configured such that its conductor width is large compared with conductor portions formed on other surfaces. More specifically, each of conductors 11 and 12 is configured to be generally wider on the first surface (refer to FIGS. 11A and 11B). Thus, since the conductor at the feed side, through which much current flows, is formed larger in width, a resistance value of such a conductor portion is decreased, leading to ease in current flow. This improves radiation efficiency.

Moreover, each of grooves formed in the second surface (substrate top portion 41A) and the third surface (substrate side portion 41C) of the dielectric substrate 10 is configured to be larger than a groove formed in the first surface (substrate side portion 41B) thereof. Thus, even if the amount of electromagnetic coupling increases at the feed side due to the increased conductor width at the feed side, since grooves on other surfaces are formed larger, the amount of electromagnetic coupling can be decreased particularly at the open end side.

Fourth Embodiment

Next, a fourth embodiment of the invention is described. Substantially the same components as in the antenna module according to each of the above embodiments are marked with the same symbols, and description of them is appropriately omitted.

Figure 13A:
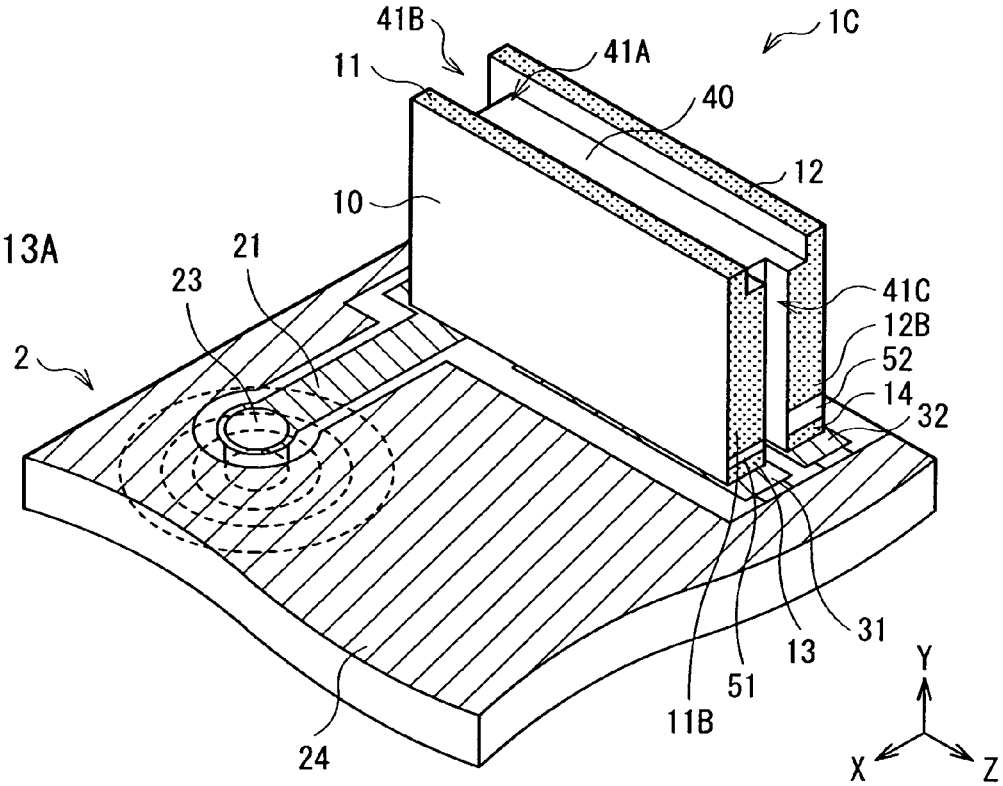
Figure 13B:
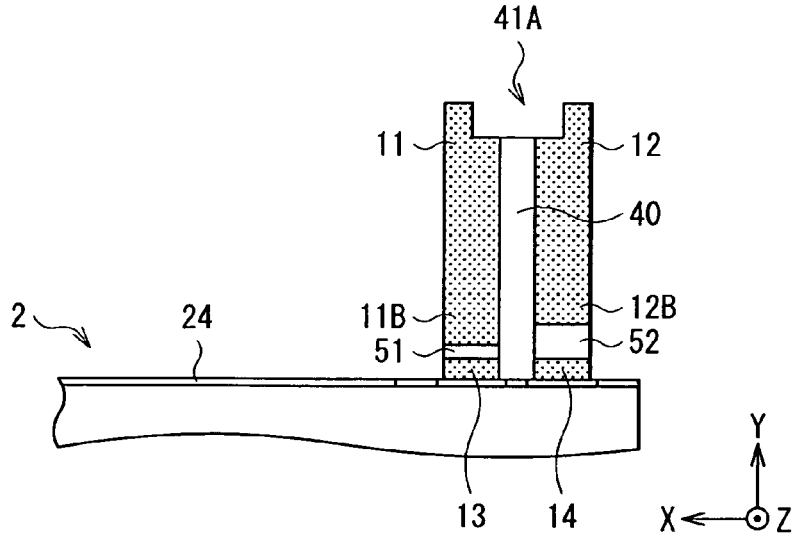
Figure 14A:
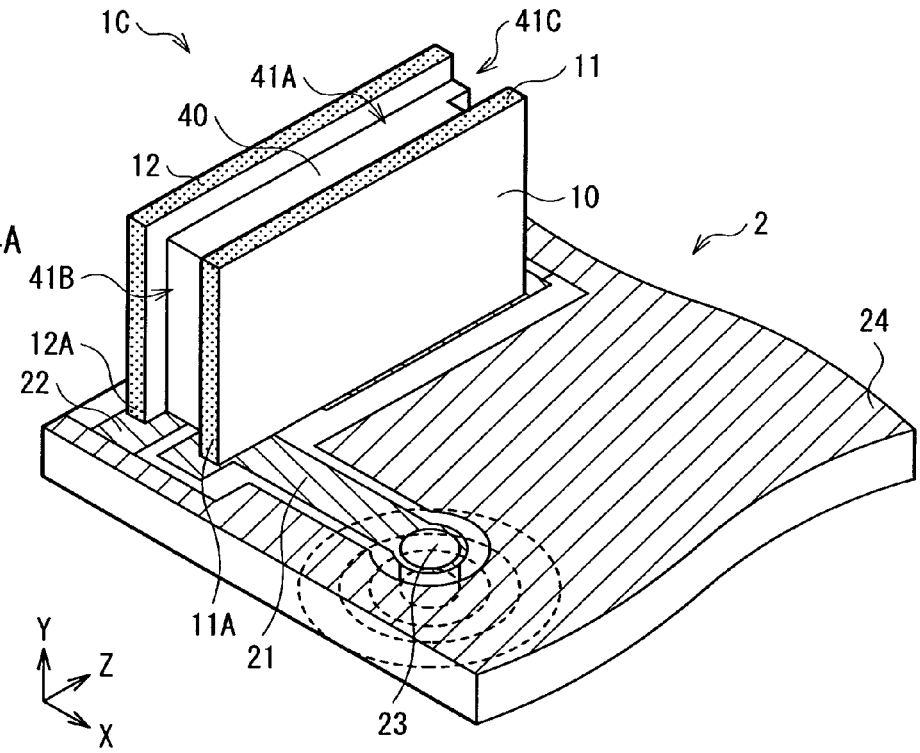
Figure 14B:
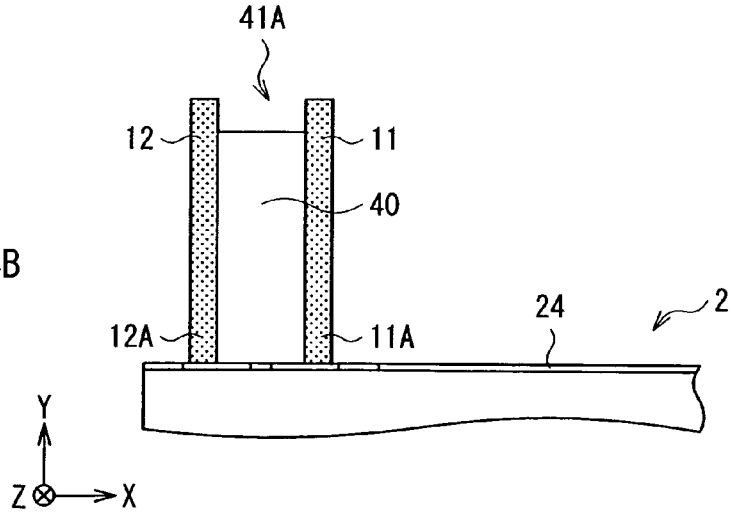
Figure 15:
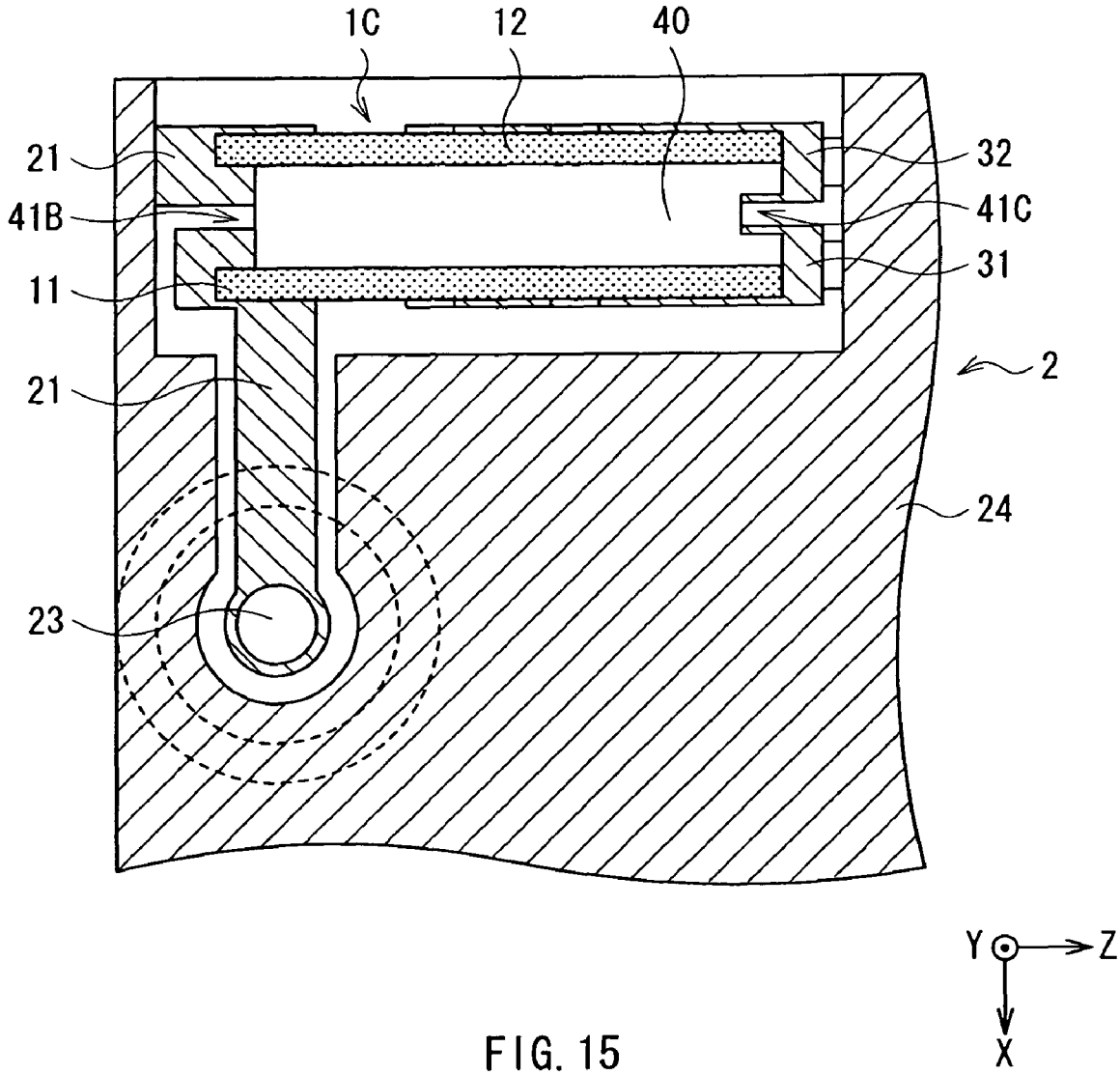
FIG. 15 shows a top view showing a configuration example of the antenna module according to the fourth embodiment of the invention.

FIGS. 13A and 13B show a configuration example of an antenna module mounted with a surface mount antenna 1C according to the embodiment. In particular, FIG. 13A shows the antenna module in a manner of being obliquely seen from a radiation side (open end side) of the surface mount antenna 1C, and FIG. 13B shows a side face of the module at the radiation side. FIG. 14A shows the antenna module in a manner of being obliquely seen from a feed side of the surface mount antenna 1C, and FIG. 14B shows a side face of the module at the feed side. FIG. 15 shows a configuration of the antenna module seen from a top.

As in the surface mount antenna 1A according to the second embodiment, the surface mount antenna 1C according to the embodiment is configured such that each of the feed radiation conductor 11 and the parasitic radiation conductor 12 is partially varied in conductor configuration and size. In addition, the embodiment is configured such that grooves of the dielectric substrate 10 are partially different in configuration and size from one another. However, while the second embodiment is configured such that conductor width is larger at the feed side, the surface mount antenna 1C according to the embodiment is configured such that conductor width is larger at the open end side.

Specifically, each of the feed radiation conductor 11 and the parasitic radiation conductor 12 at the open end side formed on the third surface (the other side face) is configured such that its conductor width is large compared with conductor portions formed on other surfaces. More specifically, each of conductors 11 and 12 is configured to be generally wider on the third surface (refer to FIGS. 13A and 13B). Thus, since conductor width at the open end side is formed larger, resonance frequency can be reduced, leading to ease in size reduction.

Moreover, each of grooves formed in the second surface (substrate top portion 41A) and the first surface (substrate side portion 41B) of the dielectric substrate 10 is configured to be larger than a groove formed in the third surface (substrate side portion 41C) thereof. Thus, even if the amount of electromagnetic coupling increases at the open end side due to the increased conductor width at the open end side, since grooves on other surfaces are formed larger, the amount of electromagnetic coupling can be decreased particularly at the feed side.

Fifth Embodiment

Next, a fifth embodiment of the invention is described. Substantially the same components as in the antenna module according to each of the above embodiments are marked with the same symbols, and description of them is appropriately omitted.

Figure 16A:
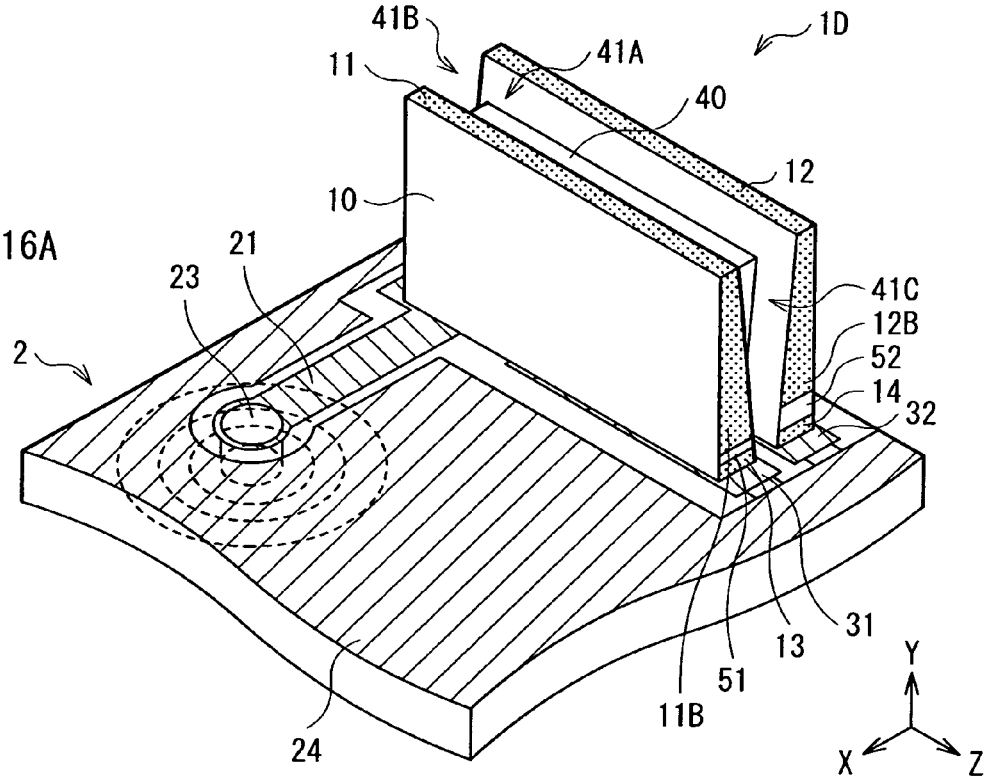
Figure 16B:
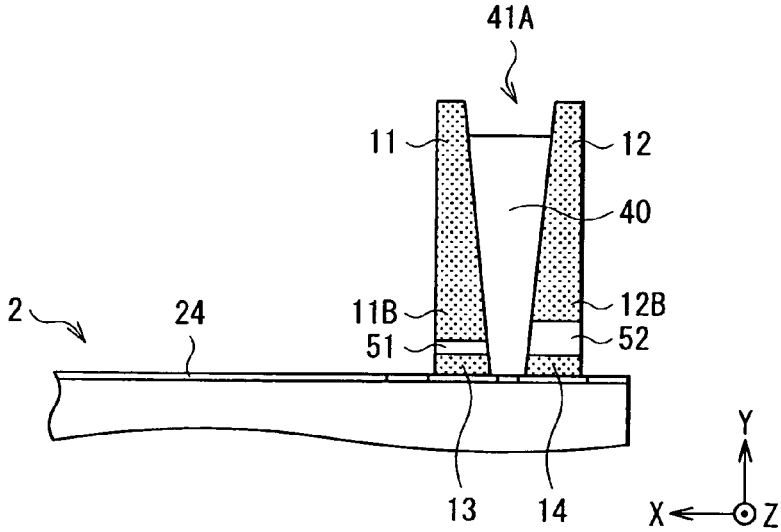
Figure 17A:
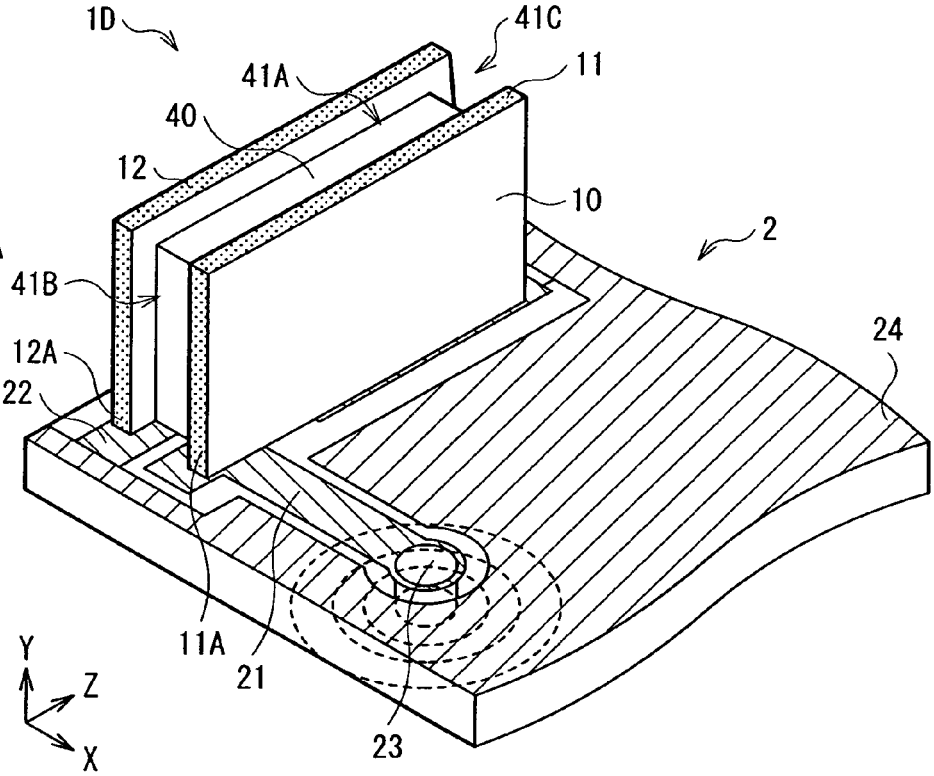
Figure 17B:
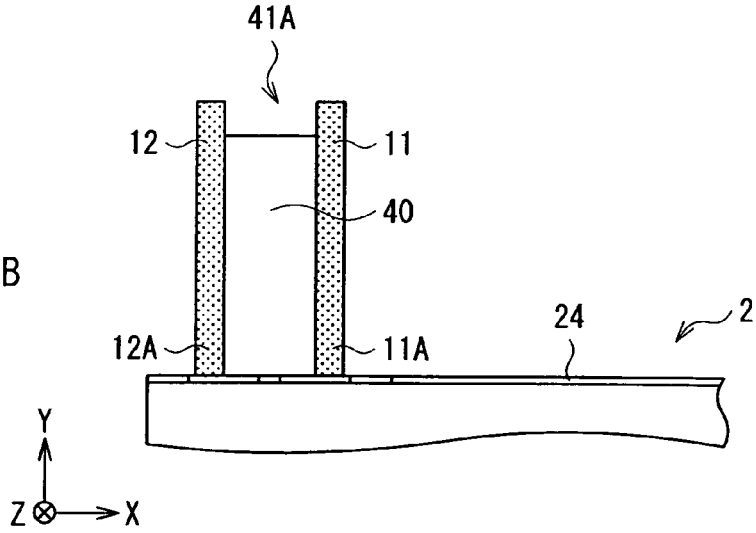
Figure 18:
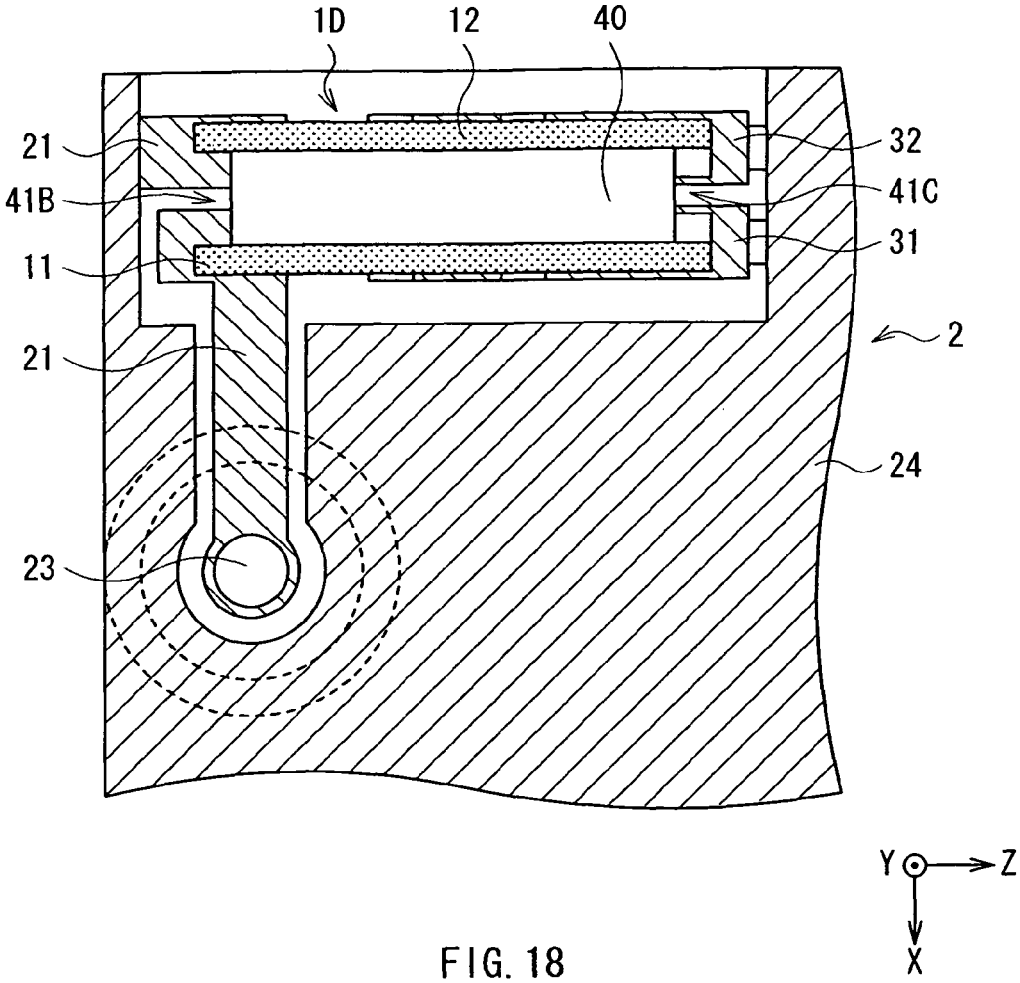
FIG. 18 shows a top view showing a configuration example of the antenna module according to the fifth embodiment of the invention.

FIGS. 16A and 16B show a configuration example of an antenna module mounted with a surface mount antenna 1D according to the embodiment. In particular, FIG. 16A shows the antenna module in a manner of being obliquely seen from a radiation side (open end side) of the surface mount antenna 1D, and FIG. 16B shows a side face of the module at the radiation side. FIG. 17A shows the antenna module in a manner of being obliquely seen from a feed side of the surface mount antenna 1D, and FIG. 17B shows a side face of the module at the feed side. FIG. 18 shows a configuration of the antenna module seen from a top.

As in the surface mount antenna 1C according to the fourth embodiment, the surface mount antenna 1D according to the embodiment is configured such that each of the feed radiation conductor 11 and the parasitic radiation conductor 12 is partially varied in conductor configuration and size. In addition, the embodiment is configured such that grooves of the dielectric substrate 10 are partially different in configuration and size from one another.

Specifically, each of the feed radiation conductor 11 and the parasitic radiation conductor 12 at the open end side formed on the third surface (the other side face) is configured such that its conductor width is large compared with conductor portions formed on other surfaces. More specifically, each of conductors 11 and 12 is configured to have such a tapered shape that the conductor becomes wider with approaching an end at the open end side (the other end 11B or 12B) (refer to FIGS. 16A and 16B). Thus, since conductor width at the open end side is formed larger, resonance frequency can be reduced, leading to ease in size reduction.

Moreover, each of grooves formed in the second surface (substrate top portion 41A) and the first surface (substrate side portion 41B) of the dielectric substrate 10 is configured to be larger than a groove formed in the third surface (substrate side portion 41C) thereof. Thus, even if the amount of electromagnetic coupling increases at the open end side due to the increased conductor width at the open end side, since grooves on other surfaces are formed larger, the amount of electromagnetic coupling can be decreased particularly at the feed side.

Sixth Embodiment

Next, a sixth embodiment of the invention is described. Substantially the same components as in the antenna module according to each of the above embodiments are marked with the same symbols, and description of them is appropriately omitted.

Figure 19:
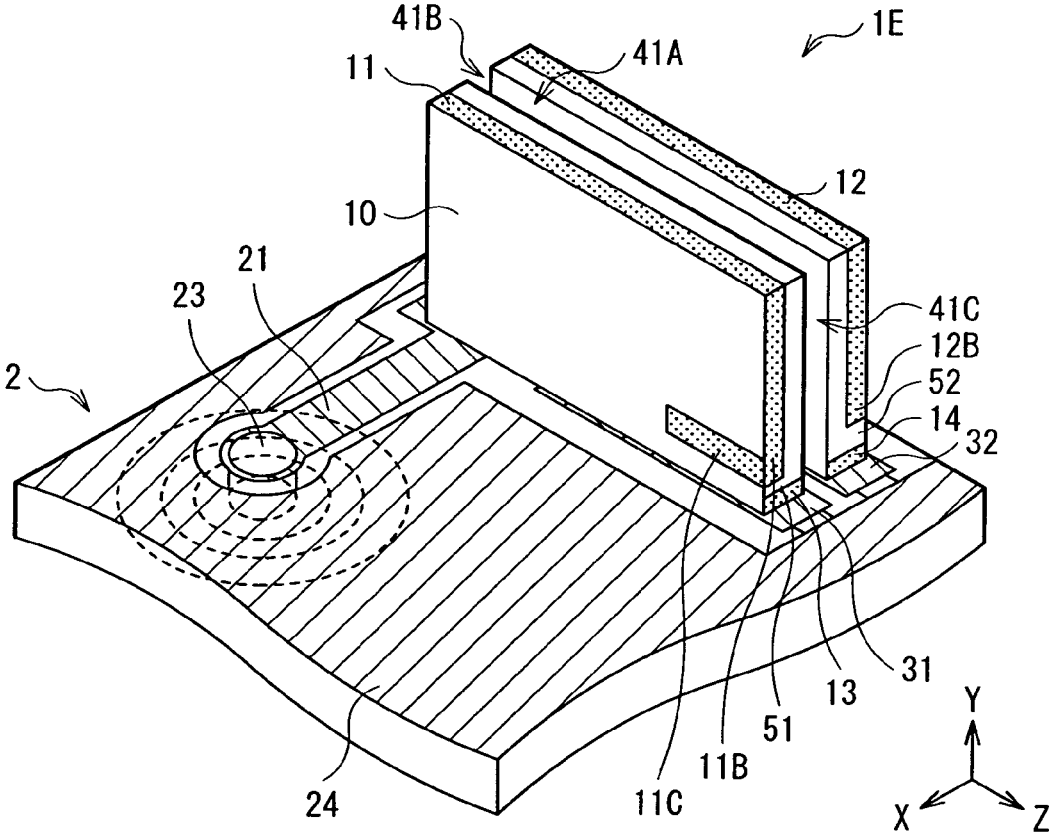
FIG. 19 shows a perspective view seen from a feed radiation electrode side, showing a configuration example of an antenna module according to a sixth embodiment of the invention.
Figure 20:
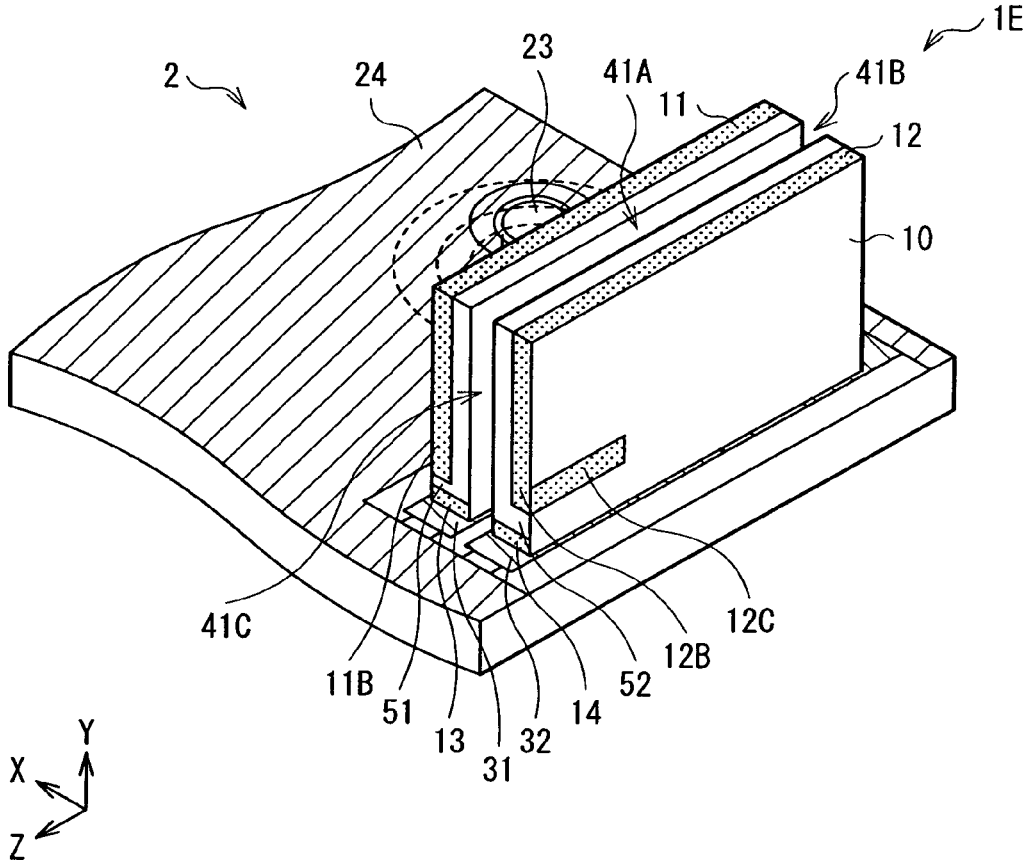
FIG. 20 shows a perspective view seen from a parasitic radiation electrode side, showing a configuration example of the antenna module according to the sixth embodiment of the invention.

FIGS. 19 and 20 show a configuration example of an antenna module mounted with a surface mount antenna 1E according to the embodiment. In particular, FIG. 19 shows the antenna module in a manner of being obliquely seen from a feed radiation conductor 11 side at a radiation side (open end side) of the surface mount antenna 1, and FIG. 20 shows the antenna module in a manner of being obliquely seen from a parasitic radiation conductor 12 side.

The surface mount antenna 1E according to the embodiment is configured such that a conductor at an open end side of each of the feed radiation conductor 11 and the parasitic radiation conductor 12 is extended compared with the surface mount antenna 1 according to the first embodiment. Specifically, the other end 11B of the feed radiation conductor 11 is extensionally formed such that it comes from the third surface into a different surface perpendicular to the first to third surfaces (refer to a conductor portion 11C shown in FIG. 19). Similarly, the other end 12B of the parasitic radiation conductor 12 is extensionally formed such that it comes from the third surface into another different surface perpendicular to the first to third surfaces (refer to a conductor portion 12C shown in FIG. 20).

According to the surface mount antenna 1E according to the embodiment, since each conductor is formed such that it comes into the different surface, conductor length is increased, and thereby resonance frequency can be reduced, leading to ease in size reduction.

Seventh Embodiment

Next, a seventh embodiment of the invention is described. Substantially the same components as in the antenna module according to each of the above embodiments are marked with the same symbols, and description of them is appropriately omitted.

Figure 21A:
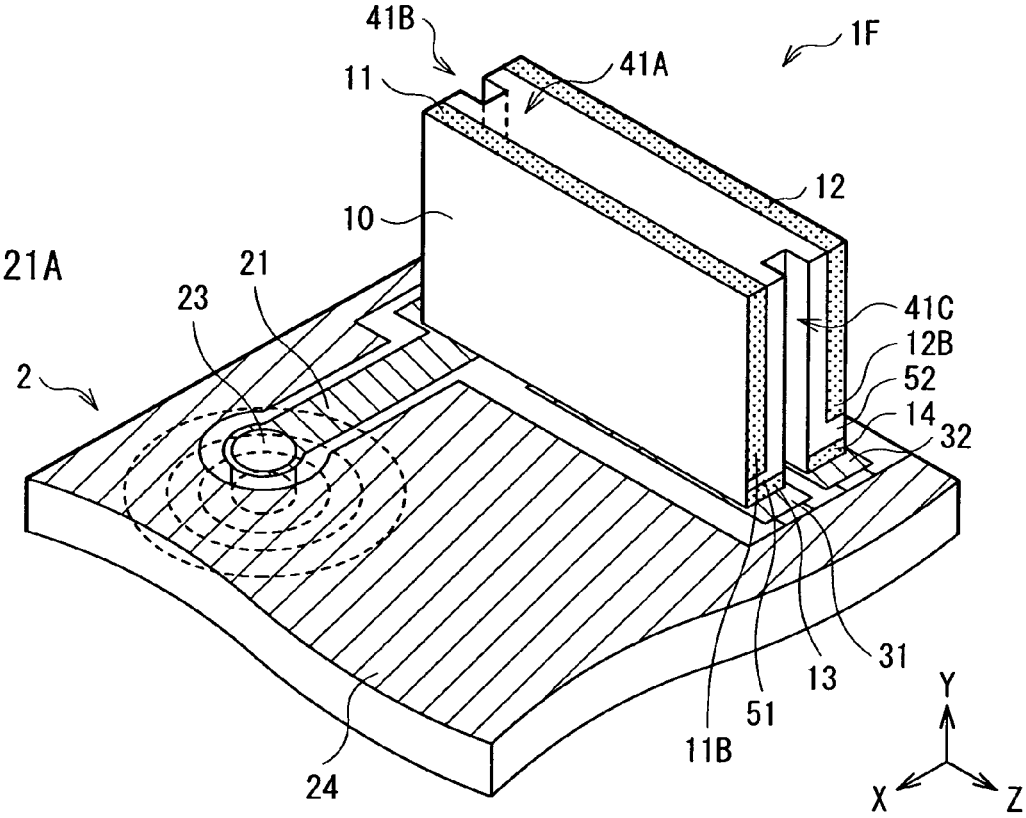
Figure 21B:
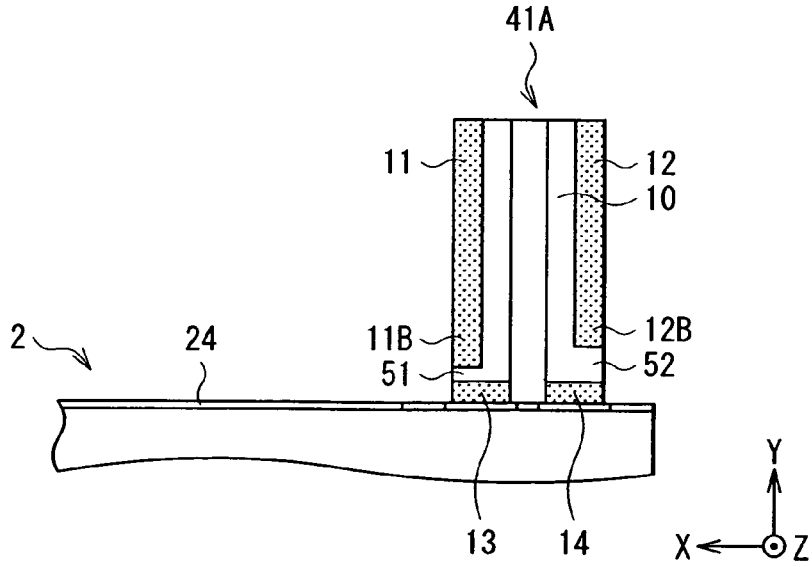
Figure 22A:
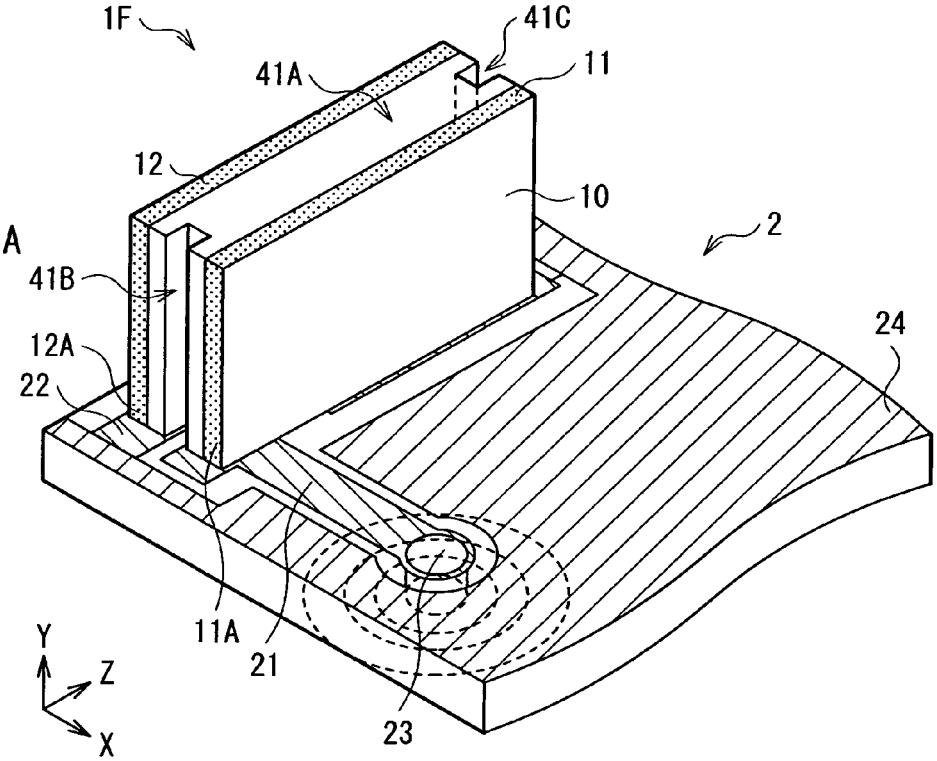
Figure 22B:
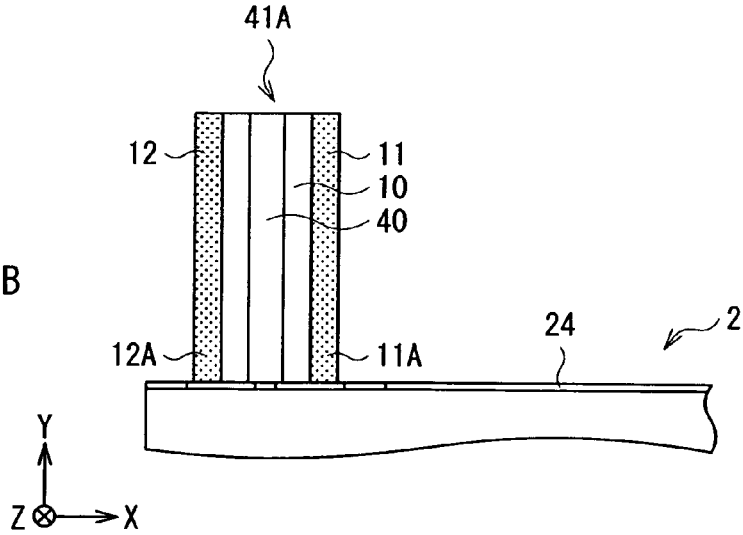
Figure 23:
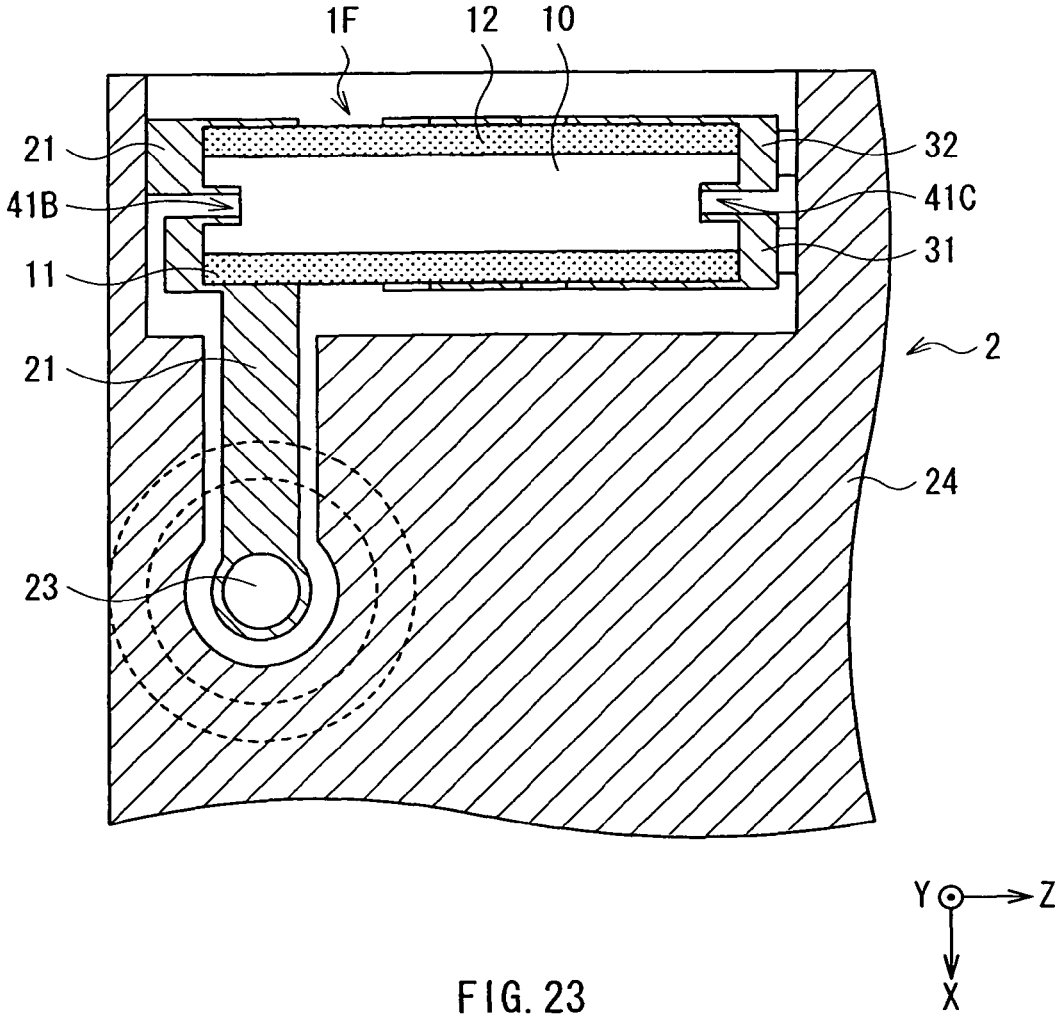
FIG. 23 shows a top view showing a configuration example of the antenna module according to the seventh embodiment of the invention.

FIGS. 21A and 21B show a configuration example of an antenna module mounted with a surface mount antenna 1F according to the embodiment. In particular, FIG. 21A shows the antenna module in a manner of being obliquely seen from a radiation side (open end side) of the surface mount antenna 1F, and FIG. 21B shows a side face of the module at the radiation side. FIG. 22A shows the antenna module in a manner of being obliquely seen from a feed side of the surface mount antenna 1F, and FIG. 22B shows a side face of the module at the feed side. FIG. 23 shows a configuration of the antenna module seen from a top.

In the surface mount antenna 1 according to the first embodiment, the groove is formed in each of the substrate top portion 41A and the substrate side portions 41B and 41C of the dielectric substrate 10. However, in the embodiment, a groove is not formed in the substrate top portion 41A, and formed only in the substrate side portions 41B and 41C. Even if a groove is provided only partially in this way, small size and broadband can be achieved compared with a previous structure.

Eighth Embodiment

Next, an eighth embodiment of the invention is described. Substantially the same components as in the antenna module according to each of the above embodiments are marked with the same symbols, and description of them is appropriately omitted.

Figure 24A:
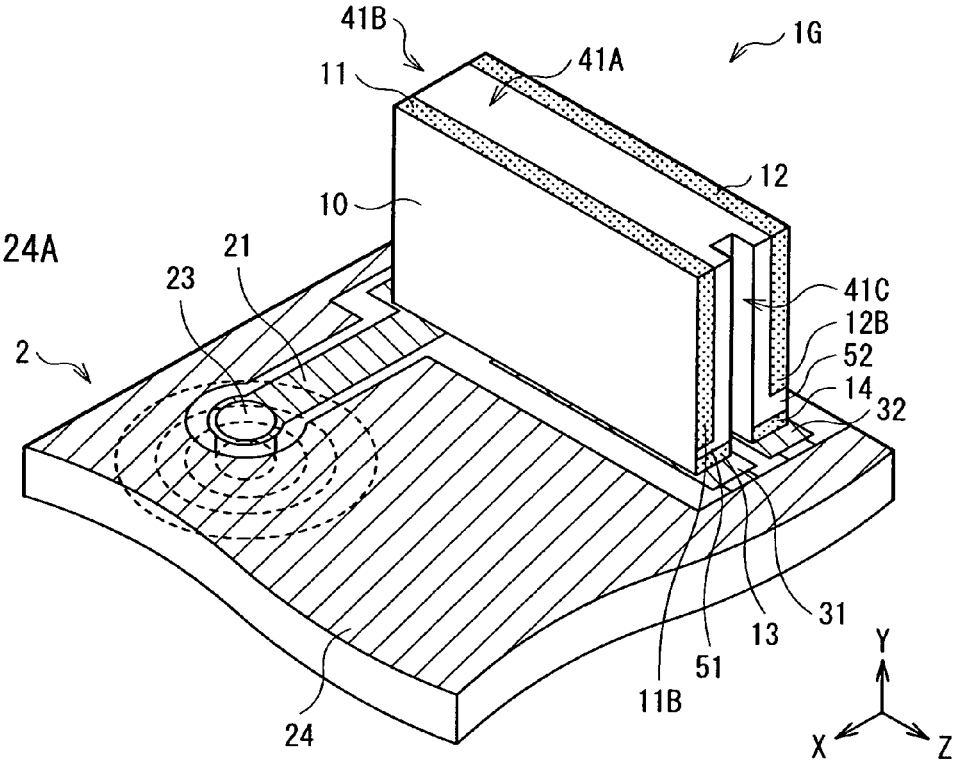
Figure 24B:
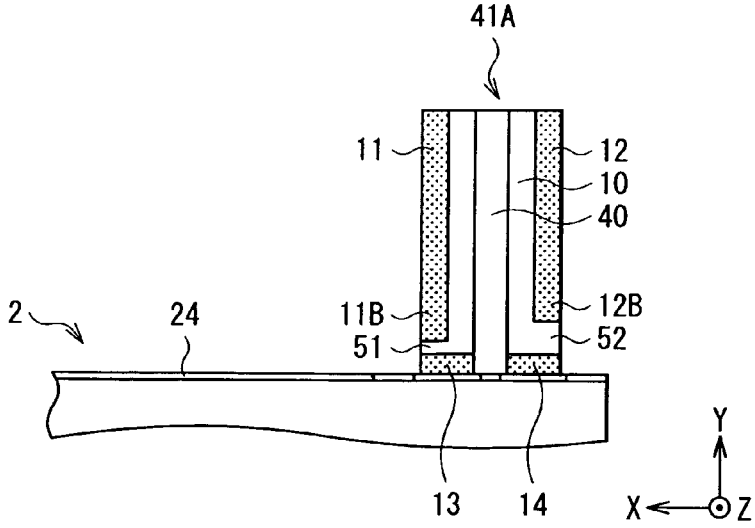
Figure 25A:
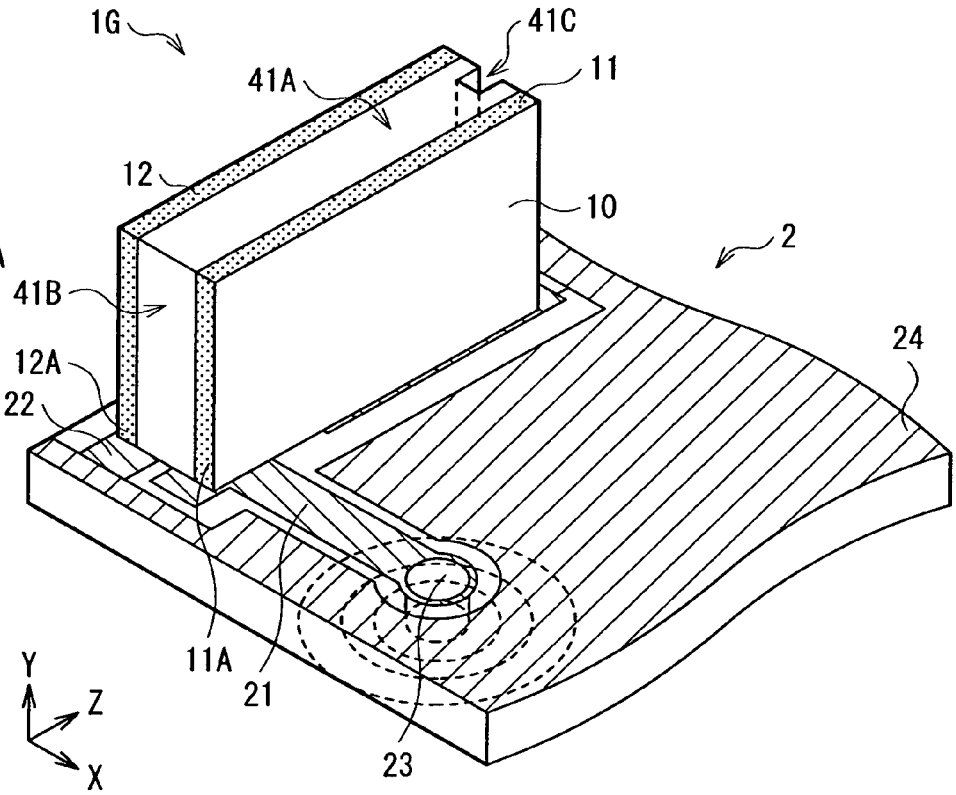
Figure 25B:
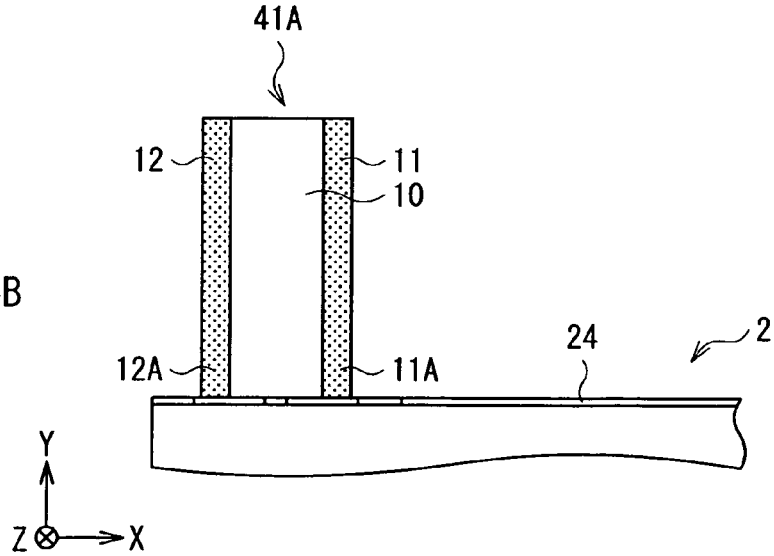
Figure 26:
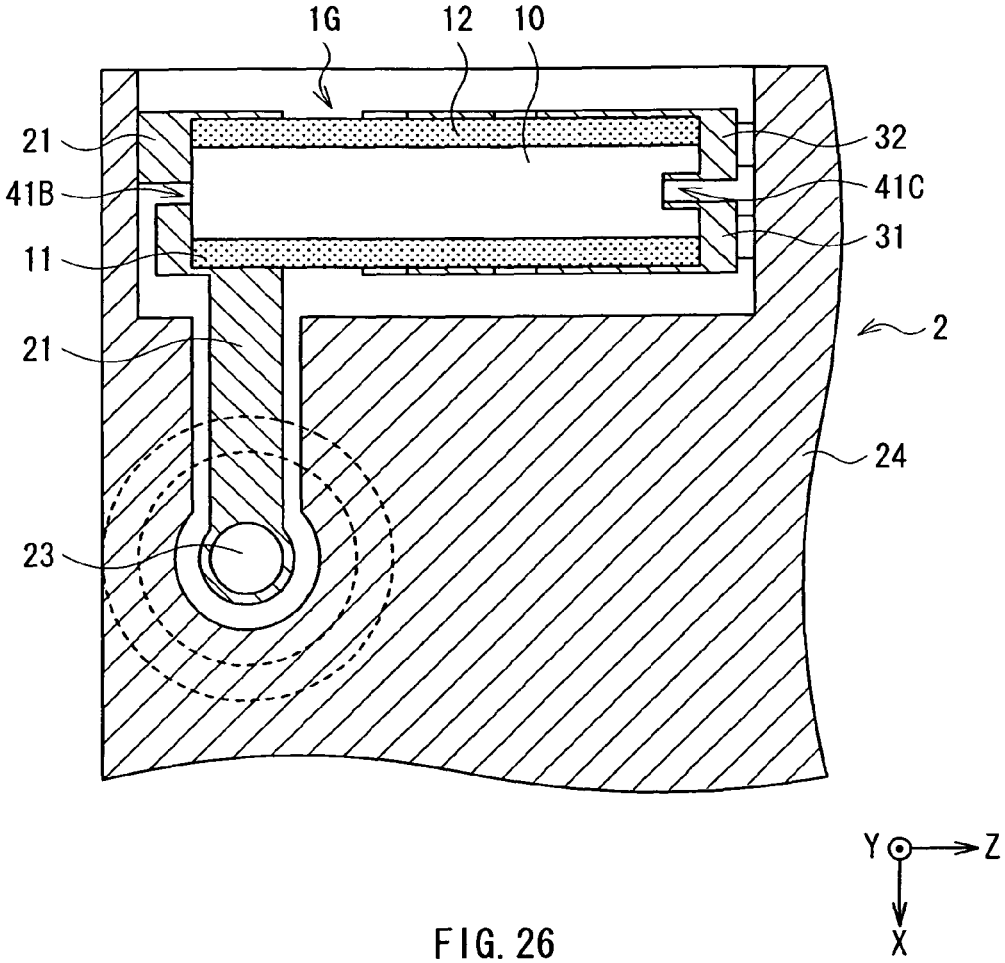
FIG. 26 shows a top view showing a configuration example of the antenna module according to the eighth embodiment of the invention.

FIGS. 24A and 24B show a configuration example of an antenna module mounted with a surface mount antenna 1G according to the embodiment. In particular, FIG. 24A shows the antenna module in a manner of being obliquely seen from a radiation side (open end side) of the surface mount antenna 1G, and FIG. 24B shows a side face of the module at the radiation side. FIG. 25A shows the antenna module in a manner of being obliquely seen from a feed side of the surface mount antenna 1G, and FIG. 25B shows a side face of the module at the feed side. FIG. 26 shows a configuration of the antenna module seen from a top.

In the surface mount antenna 1 according to the first embodiment, the groove is formed in each of the substrate top portion 41A and the substrate side portions 41B and 41C of the dielectric substrate 10. However, in the embodiment, a groove is not formed in the substrate top portion 41A and in one substrate side portion 41B, and formed only in the other substrate side portion 41C. Even if a groove is provided only in the other substrate side portion 41C in this way, small size and broadband can be achieved compared with a previous structure.

While not shown, the groove may be provided only in one substrate side portion 41B.

Ninth Embodiment

Next, a ninth embodiment of the invention is described. Substantially the same components as in the antenna module according to each of the above embodiments are marked with the same symbols, and description of them is appropriately omitted.

Figure 27:
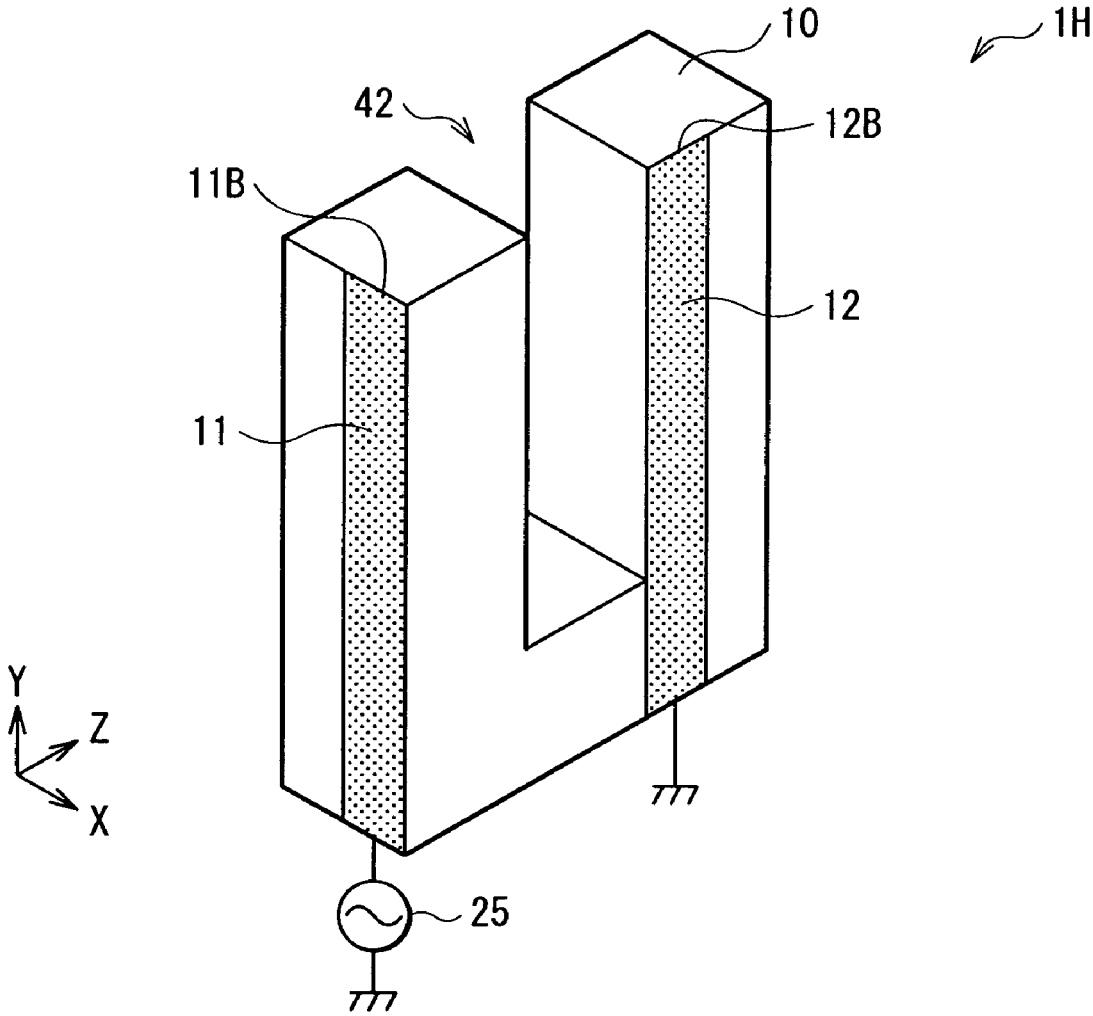
FIG. 27 shows a top view showing a configuration example of a surface mount antenna according to a ninth embodiment of the invention.
Figure 28:
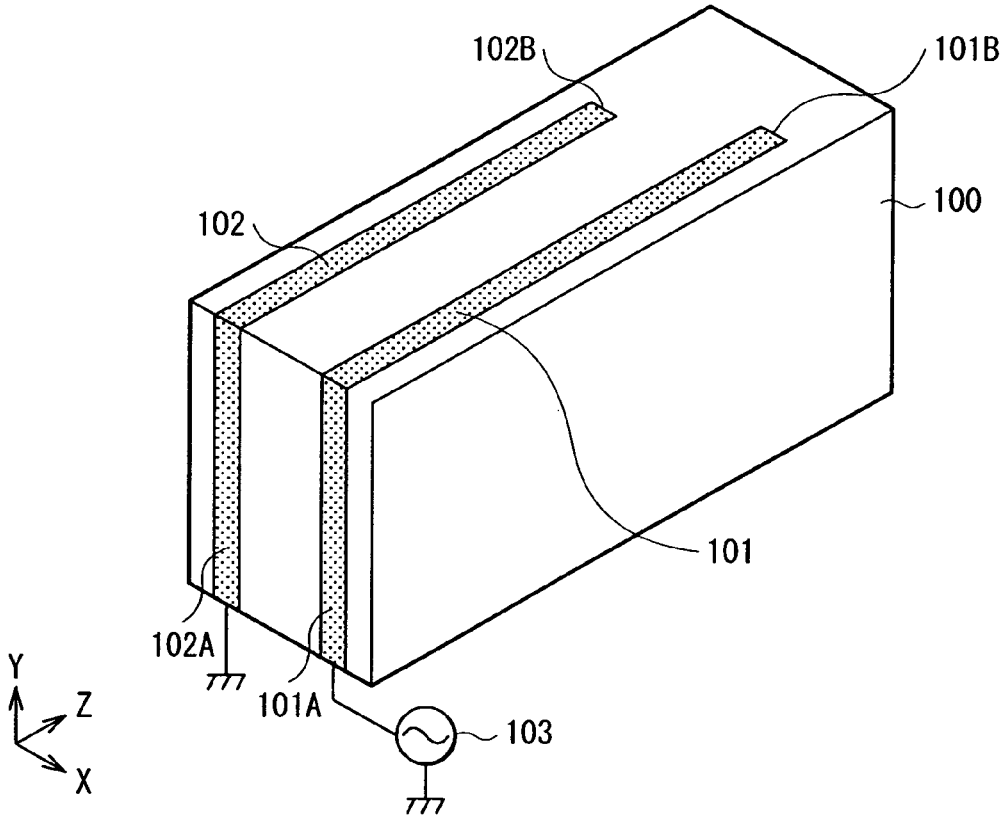
FIG. 28 RELATED ART
FIG. 28 shows a perspective view showing a configuration example of a surface mount antenna in a related art.
Figure 29:
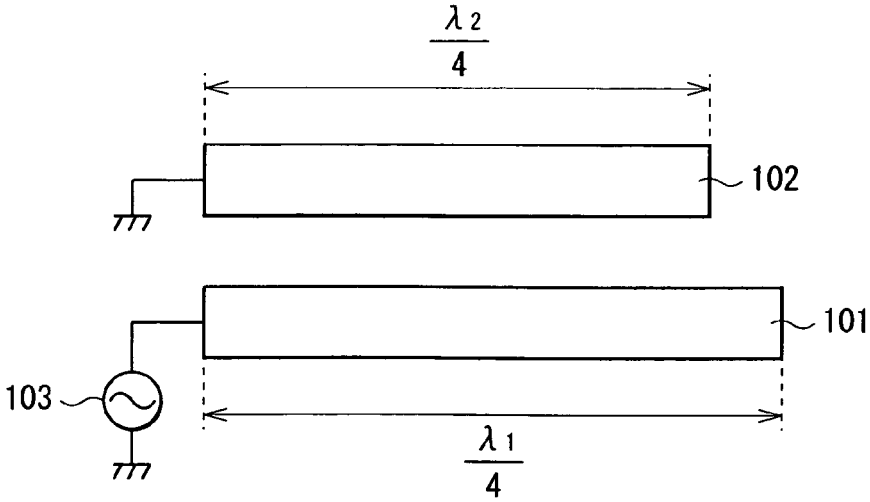
FIG. 29 RELATED ART
FIG. 29 shows an equivalent circuit diagram of the surface mount antenna in the related art.
Figure 30:
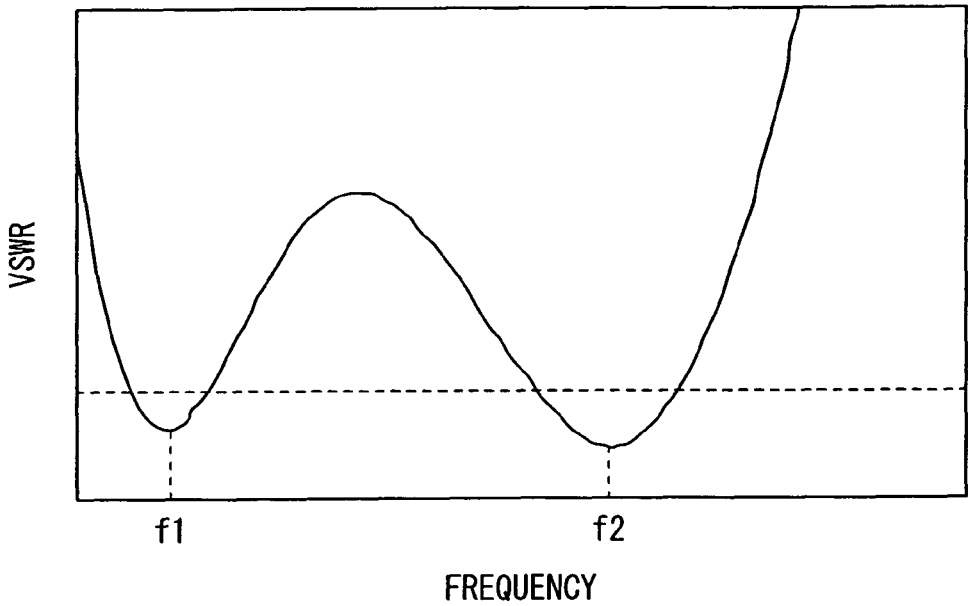
FIG. 30 RELATED ART
FIG. 30 shows a characteristic diagram showing a difficulty in a frequency characteristic of the surface mount antenna in the related art.
Figure 31:
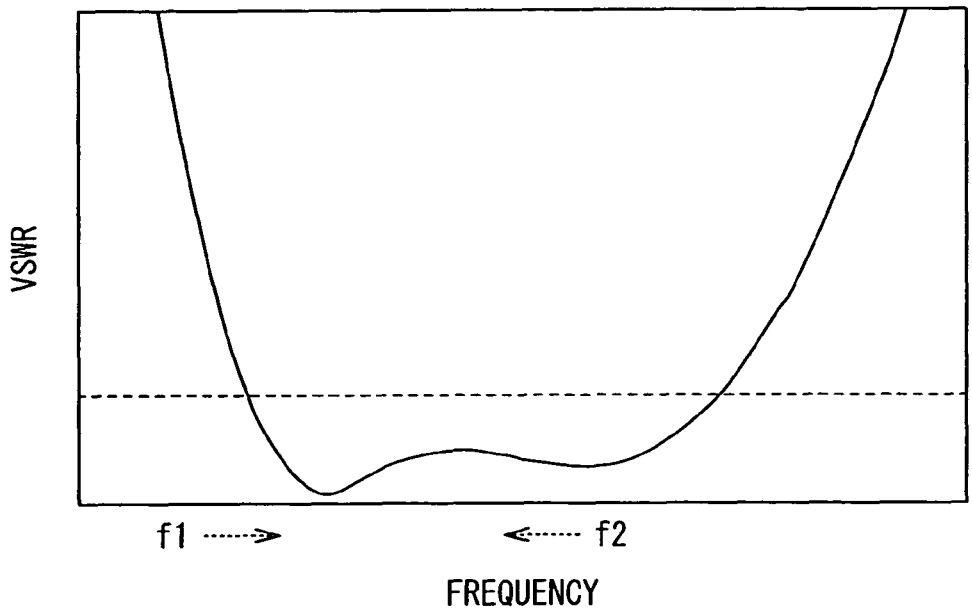
FIG. 31 shows a characteristic diagram showing an example of a frequency characteristic of a surface mount antenna being widened in bandwidth.

FIG. 27 shows a configuration example of a surface mount antenna 1H according to the embodiment. In each of the above embodiments, the feed radiation conductor 11 and the parasitic radiation conductor 12 are formed in a parallel manner on the same surface of the dielectric substrate 10. However, in the embodiment, the feed radiation conductor 11 and the parasitic radiation conductor 12 are formed on different surfaces of the dielectric substrate 10 from each other. In FIG. 27, the feed radiation conductor 11 and the parasitic radiation conductor 12 are formed on different surfaces, being perpendicular to each other, of a U-shaped dielectric substrate 10. In addition, a central portion of the dielectric substrate 10 is formed to be a groove portion 42, thereby a region between the feed radiation conductor 11 and the parasitic radiation conductor 12 is made to be a region having a low dielectric constant.

Other Embodiments

The invention is not limited to the above embodiments, and may be carried out in variously modified modes. For example, in each of the above embodiments, grooves are provided in the dielectric substrate 10 to be formed as the air layer, thereby a region having a low dielectric constant is provided. However, the region may be formed using a different dielectric layer instead of the air layer. For example, an embodiment of the invention may be configured such that each groove portion of the dielectric substrate 10 in each of the above embodiments is filled with a dielectric having a low dielectric constant compared with the dielectric substrate 10.

Moreover, for example, the first embodiment was described on a case that the feed radiation conductor 11 and the parasitic radiation conductor 12 were formed such that each conductor went around the first surface (one side face), the second surface (top), and the third surface (the other side face) of the dielectric substrate 10. However, formation positions of the feed radiation conductor 11 and the parasitic radiation conductor 12 are not limited to those in such a configuration. For example, an embodiment of the invention may be configured such that each radiation conductor is formed only on the first and second surfaces.

Moreover, each of the above embodiments was described assuming that a substrate included the dielectric substrate 10 including a dielectric material as a main material. However, a magnetic substrate including a magnetic material as a main material may be used as the substrate. In this case, a "region having a low magnetic permeability" can be provided instead of the "region having a low dielectric constant" in each of the above embodiments. The "region having a low magnetic permeability" may be an air layer given by forming a groove, or may be a different magnetic layer configured of a magnetic material with a lower magnetic permeability, which fills the groove.

It should be understood by those skilled in the art that various modifications, combinations, sub-combinations and alterations may occur depending on design requirements and other factors insofar as they are within the scope of the appended claims or the equivalent thereof.

What is claimed is:

1. A surface mount antenna:

comprising:

a substrate including a dielectric material or a magnetic material as a main material, a feed radiation conductor formed on a surface of the substrate, one end of the feed radiation conductor being formed as a first feed end to be supplied with power, and the other end thereof being formed as a first open end, and a parasitic radiation conductor formed on the surface of the substrate at a distance from the feed radiation conductor, one end of the parasitic radiation conductor being formed as a second feed end to be supplied with power from the feed radiation conductor through an action of electromagnetic coupling, and the other end thereof being formed as a second open end, wherein a region having a dielectric constant lower than that of the main material of the substrate or having a magnetic permeability lower than that of the main material of the substrate is provided between the feed radiation conductor and the parasitic radiation conductor, the substrate has a rectangular solid shape with a first surface, a second surface perpendicular to the first surface and a third surface opposed to the first surface, the feed radiation conductor and the parasitic radiation conductor are formed in parallel with each other to extend around the substrate along the first, the second and the third surfaces, the first feed end of the feed radiation conductor and the second feed end of the parasitic radiation conductor are located on the first surface of the substrate, a width, at least at the first feed end, of the feed radiation conductor on the first surface is larger than a width of the feed radiation conductor on the other surfaces, a width, at least at the second feed end, of the parasitic radiation conductor on the first surface is larger than a width of the parasitic radiation conductor on the other surfaces, the first open end of the feed radiation conductor and the second open end of the parasitic radiation conductor are located on the third surface of the substrate, and grooves are formed on at least the first surface and the third surface of the substrate in a region between the feed radiation conductor and the parasitic radiation conductor, and a groove formed in the third surface is larger than that formed in the first surface.

2. A surface mount antenna:

comprising:

a substrate including a dielectric material or a magnetic material as a main material, a feed radiation conductor formed on a surface of the substrate, one end of the feed radiation conductor being formed as a first feed end to be supplied with power, and the other end thereof being formed as a first open end, and a parasitic radiation conductor formed on the surface of the substrate at a distance from the feed radiation conductor, one end of the parasitic radiation conductor being formed as a second feed end to be supplied with power from the feed radiation conductor through an action of electromagnetic coupling, and the other end thereof being formed as a second open end, wherein a region having a dielectric constant lower than that of the main material of the substrate or having a magnetic permeability lower than that of the main material of the substrate is provided between the feed radiation conductor and the parasitic radiation conductor, the substrate has a rectangular solid shape with a first surface, a second surface perpendicular to the first surface and a third surface opposed to the first surface, the feed radiation conductor and the parasitic radiation conductor are formed in parallel with each other to extend around the substrate along the first, the second and the third surfaces, the first open end of the feed radiation conductor and the second open end of the parasitic radiation conductor are located on the third surface of the substrate, a width, at least at the first open end, of the feed radiation conductor on the third surface is larger than a width of the feed radiation conductor on the other surfaces, and a width, at least at the second open end, of the parasitic radiation conductor on the third surface is larger than a width of the parasitic radiation conductor on the other surfaces.

3. The surface mount antenna according to claim 1, further comprising a circuit element for adjusting a frequency characteristic, the circuit element being connected, via a capacitor, to the first open end of the feed radiation conductor, or to the second open end of the parasitic radiation conductor, or to both of them.

4. The surface mount antenna according to claim 1:

wherein a conductor portion in a neighborhood of the first open end in the feed radiation conductor and a conductor portion in a neighborhood of the second open end in the parasitic radiation conductor are configured to extend onto different surfaces which are perpendicular to the first to third surfaces.

5. The surface mount antenna according to claim 2:

wherein one or more grooves are formed on the substrate in at least a part of a region between the feed radiation conductor and the parasitic radiation conductor, inside spaces of the grooves functioning as the region having a low dielectric constant or a low magnetic permeability.

6. The surface mount antenna according to claim 2:

wherein the first feed end of the feed radiation conductor and the second feed end of the parasitic radiation conductor are located on the first surface of the substrate, grooves are formed on at least the first surface and the third surface of the substrate in a region between the feed radiation conductor and the parasitic radiation conductor, and a groove formed in the first surface is larger than that formed in the third surface.

7. The surface mount antenna according to claim 2, further comprising a circuit element for adjusting a frequency characteristic, the circuit element being connected, via a capacitor, to the first open end of the feed radiation conductor, or to the second open end of the parasitic radiation conductor, or to both of them.

8. The surface mount antenna according to claim 2:

wherein a conductor portion in a neighborhood of the first open end in the feed radiation conductor and a conductor portion in a neighborhood of the second open end in the parasitic radiation conductor are configured to extend onto different surfaces which are perpendicular to the first to third surfaces.

9. An antenna module configured by mounting a surface mount antenna on a circuit board:

wherein the surface mount antenna includes a substrate including a dielectric material or a magnetic material as a main material, a feed radiation conductor formed on a surface of the substrate, one end of the feed radiation conductor being supplied with power, and the other end being formed as an open end, and a parasitic radiation conductor formed on the surface of the substrate at a distance from the feed radiation conductor, one end of the parasitic radiation conductor being supplied with power from the feed radiation conductor through an action of electromagnetic coupling, and the other end being formed as an open end, wherein a region having a dielectric constant lower than that of the main material of the substrate or having a magnetic permeability lower than that of the main material of the substrate is provided between the feed radiation conductor and the parasitic radiation conductor, the substrate has a rectangular solid shape with a first surface, a second surface perpendicular to the first surface and a third surface opposed to the first surface, the feed radiation conductor and the parasitic radiation conductor are formed in parallel with each other to extend around the substrate along the first, the second and the third surfaces, the first open end of the feed radiation conductor and the second open end of the parasitic radiation conductor are located on the third surface of the substrate, a width, at least at the first open end, of the feed radiation conductor on the third surface is larger than a width of the feed radiation conductor on the other surfaces, and a width, at least at the second open end, of the parasitic radiation conductor on the third surface is larger than a width of the parasitic radiation conductor on the other surfaces.

10. The antenna module according to claim 9:

wherein the surface mount antenna is mounted such that the first open end of the feed radiation conductor and the second open end of the parasitic radiation conductor are situated to point inward on the circuit board.

* * * * *